US012638225B2

(12) United States Patent
Li

(10) Patent No.: US 12,638,225 B2
(45) Date of Patent: May 26, 2026

(54) ICE MAKING MODULE, AND ICE MAKER AND REFRIGERATOR HAVING THE SAME

(71) Applicant: Zhaoyang Li, Qingdao (CN)

(72) Inventor: Zhaoyang Li, Qingdao (CN)

( * ) Notice: Subject to any disclaimer, the term of this patent is extended or adjusted under 35 U.S.C. 154(b) by 47 days.

(21) Appl. No.: 18/723,861

(22) PCT Filed: Jul. 4, 2022

(86) PCT No.: PCT/CN2022/103660

§ 371 (c)(1),
(2) Date: Jun. 24, 2024

(87) PCT Pub. No.: WO2023/087736

PCT Pub. Date: May 25, 2023

(65) Prior Publication Data

US 2025/0067490 A1 Feb. 27, 2025

(30) Foreign Application Priority Data

May 7, 2022 (CN) ..... 202210492613.6

(51) Int. Cl.
*F25C 5/04* (2006.01)
*F25C 1/04* (2018.01)
*F25C 1/25* (2018.01)

(52) U.S. Cl.
CPC ..... *F25C 5/04* (2013.01); *F25C 1/04* (2013.01); *F25C 1/25* (2018.01);
(Continued)

(58) Field of Classification Search
CPC ..... F25C 1/04; F25C 1/22; F25C 1/25; F25C 2305/0221; F25C 2400/10; F25C 2400/14;
(Continued)

(56) References Cited

U.S. PATENT DOCUMENTS 9,038,411 B2 * 5/2015 Matsumoto ..... F25C 1/04 62/345
9,151,527 B2 * 10/2015 Boarman ..... F25C 1/22
(Continued)

FOREIGN PATENT DOCUMENTS

CN 1141417 A 1/1997
CN 2332493 Y 8/1999
(Continued)

*Primary Examiner* — Filip Zec
(74) *Attorney, Agent, or Firm* — Jiwen Chen; Joywin IP Law PLLC

(57) ABSTRACT

An ice making module (100), and an ice maker and refrigerator having same. In the ice making module (100), a lifting device drives an upper die (26) to ascend or descend. After descending, the upper die (26) matches with a lower die (13) to form a plurality of ice making cavities. The top of the upper die (26) is provided with a plurality of water inlet holes, which are respectively in communication with the cavities. A quantitative water supply system (7) is in communication with the water inlet holes (261) to achieve quantitative water supply. The lower die (13) is connected to a turning device. The bottom of the lower die (13) is attached to a heat transfer block (12). Further comprised is a separation apparatus and/or a vent hole (122). The separation apparatus is used for separating the heat transfer block (12) and the lower die (13). The vent hole (122) communicates a gap between the heat transfer block (12) and the lower die (13). By means of the present ice making module (100), ice can be rapidly made, the dies can be rapidly separated from the heat source, the dies are easy to turn over, and the ice maker can collect overflow water to prevent the overflow water from soaking the device. The refrigerator is connected in series with an evaporator (33) of the ice making module (100) by means of an evaporator (102) of the refrigerator, or directly uses air from an air port of an air duct of a freezing
(Continued)

chamber of the refrigerator to cool the dies, thereby saving energy.

14 Claims, 12 Drawing Sheets

(52) U.S. Cl.
CPC .. *F25C 2305/0221* (2021.08); *F25C 2400/10* (2013.01); *F25C 2500/06* (2013.01)

(58) Field of Classification Search
CPC .... F25C 2500/06; F25C 2700/12; F25C 5/04; F25C 5/08; F25C 5/187; F25C 5/24; F25D 2323/122
See application file for complete search history.

(56) References Cited

U.S. PATENT DOCUMENTS

| | | | | |
|---|---|---|---|---|
| 9,234,689 | B2 * | 1/2016 | Son | F25C 1/10 |
| 9,696,079 | B2 * | 7/2017 | Boarman | F25C 1/10 |
| 11,035,602 | B2 * | 6/2021 | Bertolini | F25C 1/22 |
| 11,105,547 | B2 * | 8/2021 | Song | F25C 1/18 |
| 11,408,659 | B2 * | 8/2022 | Notaney | F25C 1/24 |
| 11,543,167 | B2 * | 1/2023 | Mitchell | F25C 5/22 |
| 12,235,041 | B2 * | 2/2025 | Jakobsen | F25D 3/08 |
| 12,331,976 | B2 * | 6/2025 | Lee | F25C 5/187 |
| 2007/0113578 | A1 * | 5/2007 | Wu | F25C 5/182 62/344 |
| 2010/0218542 | A1 * | 9/2010 | McCollough | F25D 11/022 700/275 |
| 2012/0023996 | A1 * | 2/2012 | Herrera | F25C 1/04 249/70 |
| 2014/0165619 | A1 * | 6/2014 | Culley | F25C 5/08 62/344 |
| 2014/0165621 | A1 | 6/2014 | Boarman et al. | |
| 2017/0211865 | A1 * | 7/2017 | Lee | F25C 5/22 |
| 2018/0231294 | A1 * | 8/2018 | Song | F25C 5/182 |
| 2019/0041112 | A1 * | 2/2019 | Chatelle | F25C 5/22 |
| 2019/0219317 | A1 * | 7/2019 | Yoon | F25C 5/08 |
| 2020/0064043 | A1 * | 2/2020 | Larson | F25C 5/08 |
| 2020/0158413 | A1 * | 5/2020 | Kim | F25C 1/10 |

FOREIGN PATENT DOCUMENTS

| | | |
|---|---|---|
| CN | 102878744 A | 1/2013 |
| CN | 102997536 A | 3/2013 |

* cited by examiner

ICE MAKING MODULE, AND ICE MAKER AND REFRIGERATOR HAVING THE SAME

This is a U.S. national stage application of PCT Application No. PCT/CN2022/103660 under 35 U.S.C. 371, filed Jul. 4, 2022 in Chinese, claiming priority of Chinese Application No. 202210492613.6, filed May 7, 2022, all of which are hereby incorporated by reference.

TECHNICAL FIELD

The present invention belongs to the field of ice making devices, specifically, it relates to an ice making module and an ice maker and refrigerator with the same.

BACKGROUND TECHNOLOGY

When making ice blocks, it is necessary to supply a quantitative amount of water required for ice making to meet the demands for the volume and consistency of the ice blocks. Some ice making equipment uses molds to make ice, but the cooling speed of the ice making process is relatively slow. Additionally, when the ice making equipment demolds the ice blocks, it uses heating to melt the surface of the ice blocks to prevent them from sticking to the mold. However, prolonged heating of the equipment can cause the ice blocks to over-melt. Even if the heat source is quickly cut off, there is still the issue of continued heat release, so the mold needs to be quickly separated from the heat source. In the case of demolding by flipping the lower mold, the melted water on the exterior of the lower mold may cause difficulty in separating the lower mold from other components due to surface tension formed by water in the fitting gaps when the lower mold is in close contact with other components. During the demolding process, the ice blocks may not be completely demolded, and when water is added again for ice making, it may overflow and cause the equipment to be soaked, leading to damage.

In view of this, the present invention is proposed.

SUMMARY OF THE INVENTION

The technical problem that the present invention aims to solve is to overcome the deficiencies of existing technologies by providing an ice making module that can supply water quantitatively, make ice quickly, and release the ice blocks quickly.

The second object of the present invention is to provide an ice maker equipped with the ice making module.

The third object of the present invention is to provide a refrigerator equipped with the ice making module.

To solve the above technical problems, the basic concept of the technical solution adopted by the present invention is:

An ice making module, including an upper mold, a lower mold, a refrigeration module, a quantitative water supply system, a separation mechanism, and an ice release mechanism. The upper mold and lower mold cooperate to form multiple ice making cavities, and the quantitative water supply system supplies water quantitatively to the ice making cavities. The ice making cavities are connected to the refrigeration module. The separation mechanism drives the upper mold and lower mold to separate, and the ice release mechanism drives the formed ice blocks out of the ice making cavities after the molds are separated.

Furthermore, the ice making module also includes a heat transfer block that is attached to the bottom of the lower mold and connected to the evaporator of the refrigeration module to quickly transfer cold to the lower mold. It also includes a separation device and/or ventilation holes, where the separation device is used to separate the heat transfer block and the lower mold, and the ventilation holes connect the gap between the heat transfer block and the lower mold.

Furthermore, the ice making module also includes a bracket, and the separation mechanism includes a lift motor and a lift transmission device. The lift motor is fixed on the bracket and connected to the lift transmission device, which drives the upper mold to move up and down.

Furthermore, the ice making module also includes an upper mold fixing component fixed to the top of the upper mold. The upper mold fixing component is connected to the lift transmission device, which drives the upper mold fixing component to move up and down.

Furthermore, the ice making module also includes ice breaking components fixed to the bracket and located directly above water inlet holes at the top of the upper mold. When the upper mold moves up, the ice breaking components insert into the water inlet holes to exert force on the ice blocks remaining in the upper mold, causing them to be released.

Furthermore, the ice release mechanism includes a flipping motor, a flipping transmission device, and a flipping limit device. The flipping transmission device is connected to the output shaft of the flipping motor and the lower mold, respectively. The flipping limit device controls the flipping angle and direction of the flipping motor.

Furthermore, the quantitative water supply system includes a dual-chamber water box, a water pump, and water pipes. The inside of the dual-chamber water box is divided into a large chamber and a small chamber by a partition rib, with a partition gap at the top of the partition. The side wall of the small chamber has a water inlet, which is higher than the partition gap and/or the partition. The bottom of the small chamber has a water outlet connected to the water pump and the water inlet hole of the upper mold through a water pipe.

Furthermore, the water inlet of the small chamber is connected to a water source through a water pipe and a water pump that controls the quantitative water intake.

Furthermore, the quantitative water supply system includes a quantitative water box, a solenoid valve, and water pipes. A water source is connected to the water inlet of the quantitative water box through a water pump and water pipes, providing quantitative water. The water outlet of the quantitative water box is connected to the water inlet holes of the upper mold through a solenoid valve and water pipes. The quantitative water box is also equipped with an overflow outlet to ensure a constant water level inside the quantitative water box.

The present invention also provides an ice maker, including the aforementioned ice making module. The top of a first annular wall of the upper mold fixing component, which forms an avoiding hole, is provided with a first gap. The water inlet hole of the upper mold is located inside the avoiding hole, and the first gap is connected to an overflow pipe through an overflow channel. The overflow pipe drains to a water storage box or the large chamber of the dual-chamber water box.

Furthermore, the ice maker also includes an outer shell part, a door part, an ice receiving basket, and a water collection box. The ice making module is located in the inner cavity formed by the outer shell part. The front side of the outer shell part is provided with an opening corresponding to the position of the lower mold. The door part is located at the opening, and the ice receiving basket is located inside the door, below the lower mold. The water collection box is set below the overflow pipe, and a sensor is installed at the bottom of the inner cavity of the water collection box. The water collection box receives the overflow water and drains it to the water storage box or the large chamber of the dual-chamber water box.

Furthermore, the ice maker also includes ice sensors to detect whether the ice receiving basket is full.

Furthermore, the ice maker also includes an ice release detection device to detect whether the ice blocks have been released.

The present invention also provides a refrigerator, including the aforementioned ice making module. The dual-chamber water box or the quantitative water box is located in the refrigeration compartment of the refrigerator, and the evaporator of the refrigeration module is connected to the evaporator of the refrigerator. The ice making module and the ice receiving basket are located in the freezer compartment of the refrigerator.

Alternatively, the refrigerator includes the aforementioned ice making module, with the dual-chamber water box or the quantitative water box located in the refrigeration compartment, and the ice making cavity located in the freezer compartment of a frost-free refrigerator. The refrigeration module uses the refrigeration system of the frost-free refrigerator, and the cold air is directly blown onto the mold surface from an air vent of the freezer for ice making.

Compared to the prior art, the present invention has the following beneficial effects:

The present invention discloses an ice making module and an ice maker and refrigerator with the same. When making ice, after the upper and lower molds are closed, the quantitative water supply system injects a specific amount of water into the ice making cavity formed by the closed molds. The quantitative water supply system has a quantitative water detection device to achieve quantitative water storage and thus quantitative water supply. The evaporator cools the molds through heat transfer blocks, allowing the water in the molds to freeze quickly into ice blocks. Once the ice making process is complete, the lift motor and lift transmission device act to move the upper mold fixing component and the upper mold upward. The ice breaking component exerts force on the ice blocks remaining in the upper mold, causing them to fall into the lower mold. The separation device quickly separates the lower mold from the heat transfer block, and after a certain height is reached, the flipping motor begins to work, rotating the lower mold through the flipping transmission device. After rotating to a certain angle, the rotation stops, and the ice blocks fall into the ice receiving basket due to gravity. After the ice blocks slide off, the flipping motor reverses to return the lower mold to its original position, while the upper mold descends back to its position, closing the molds for another ice making cycle. The operation is simple, ice making is convenient, water supply is quantitative, ice making is fast, the molds and heat source can be separated quickly, the mold flipping is easy, and the ice maker has the beneficial effects of collecting overflow water to prevent equipment damage due to water immersion. The refrigerator has the beneficial effects of utilizing the refrigerator's evaporator in series with the ice making module's evaporator to save energy, or directly using the cold air from the freezer compartment to cool the molds for ice making, thereby saving energy.

The specific implementation of the invention will be further described in detail below in conjunction with the accompanying drawings.

DESCRIPTION OF THE DRAWINGS

The drawings form a part of the present invention and are used to provide further understanding of the invention. The illustrative embodiments and their descriptions serve to explain the invention but do not unduly limit it. It is evident that the drawings described below represent only some embodiments, and those skilled in the art can derive other drawings based on these without creative effort. In the drawings.

Figure 1:
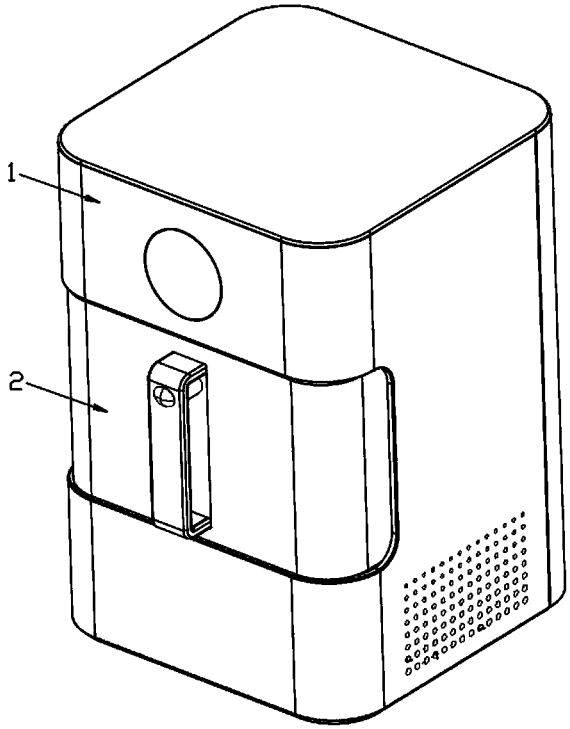
FIG. 1 is a schematic exterior view of the ice maker according to the present invention.

In the drawings, the reference numerals and their meanings are as follows: 1. outer shell part; 2. door part; 3. inner liner; 4. water storage box; 5. water pump; 6. water supply pipe; 7. quantitative water box; 8. solenoid valve; 9. solenoid valve bracket; 10. water inlet pipe; 11. U-shaped bracket cover; 12. heat transfer block; 13. lower mold; 14. upper mold fixing component; 15. water distribution tank; 16. U-shaped bracket; 17. guide rod; 18. screw rod; 19. worm wheel; 20. open retaining ring; 21. worm gear; 22. lifting transmission shaft; 23. ice breaking component; 24. lifting motor; 25. flipping motor; 26. upper mold; 27. nut; 28. insulating foam; 29. drainage funnel; 30. flipping control component; 31. flipping connecting rod; 32. motor bracket; 33. evaporator; 34. lower bearing; 35. lower bearing seat; 36. transmission shaft sleeve; 37. friction shaft sleeve; 38. upper bearing; 39. upper bearing seat; 40. fixing pin; 41. shaft sleeve; 42. sensor bracket; 43. limit sensor; 44. limit lever; 45. lever shaft; 46. flipping limit sensor; 47. condenser; 48. compressor; 49. base; 50. clean water pipe; 51. inductive sensor; 52. rubber sealing strip; 53. ice sensor; 54. water collection box; 55. water collection box drainage hole; 56. drainage pipe; 57. drainage tank; 58. heating wire; 59. ice receiving basket; 60. sensor fixing box; 61. ice release detection sensor; 71. water inlet of the quantitative water box; 72. drainage outlet of the quantitative water box; 73. water outlet of the quantitative water box; 74. temperature sensor; 80. large chamber; 81. small chamber; 82. partition rib; 83. water outlet of the large chamber; 84. water inlet of the small chamber; 85. water outlet of the small chamber; 86. water pump in water storage box; 87. water outlet connecting pipe; 88. water inlet connecting pipe; 89. partition gap; 90. dual-chamber water box; 91. water level sensor; 121. positioning hollow shaft; 122. ventilation hole; 131. fixing hole; 132. surrounding barrier; 141. guide hole; 142. avoiding hole; 143. overflow channel; 144. overflow pipe; 145. first gap; 151. water inlet funnel; 152. water inlet channel; 161. shaft sleeve hole; 162. guide hollow column; 181. limit step; 221. pin hole; 261. water inlet hole; 262. water level balancing channel; 263. second gap; 301. rotating arm; 311. limit groove; 100. ice making module; 101. freezer compartment; 102. refrigerator evaporator; 104. water supply pump; 105. water supply pipeline; 106. air vent; 107. top pillar.

It should be noted that these drawings and descriptions are not intended to limit the scope of the invention in any way, but to explain the concept of the invention by referring to specific embodiments for those skilled in the art.

DETAILED DESCRIPTION OF THE INVENTION

To make the objects, technical solutions, and advantages of the embodiments of the present invention clearer, the following will describe the technical solutions of the embodiments in detail with reference to the attached drawings. The following embodiments are used to illustrate the invention but are not intended to limit its scope.

In the description of the present invention, it should be noted that unless otherwise specified and limited, the terms "install," "connect," and "join" should be understood broadly. For example, they can refer to fixed connections, removable connections, or integral connections; they can be mechanical or electrical connections; they can be direct or indirect through an intermediary. For those skilled in the art, the specific meanings of these terms in the present invention can be understood according to specific circumstances.

Embodiment 1

In an ice making module provided by the present invention, a separation mechanism drives an upper mold and a lower mold to separate or close. When the upper and lower molds close, they form multiple ice making cavities. After ice making is completed, the upper and lower molds separate, and a de-icing mechanism releases the formed ice blocks from the ice making cavities.

The bottom of a lower mold is connected to a cooling module, transferring the cooling from the cooling module to the ice making cavities, cooling the water inside and eventually forming ice blocks.

A quantitative water supply system provides a measured amount of water to the ice making cavities to control the weight of the ice blocks. This system includes a quantitative water supply detection device.

Specifically, the components and structures include:

In the present embodiment, the separation mechanism is a lifting device that drives the upper mold to move vertically up and down, thus separating or closing with the lower mold. As shown in FIG. 6, FIG. 7, FIG. 8, and FIG. 9, the lifting device includes a lifting motor 24 and a lifting transmission device. The lifting transmission device is connected to both the upper mold and the lifting motor 24. Driven by the lifting motor 24, the upper mold moves vertically up and down. The lifting transmission device includes a lifting transmission shaft 22, a transmission shaft sleeve 36, worm gears 21, worm wheels 19, and screw rods 18.

Figure 6:
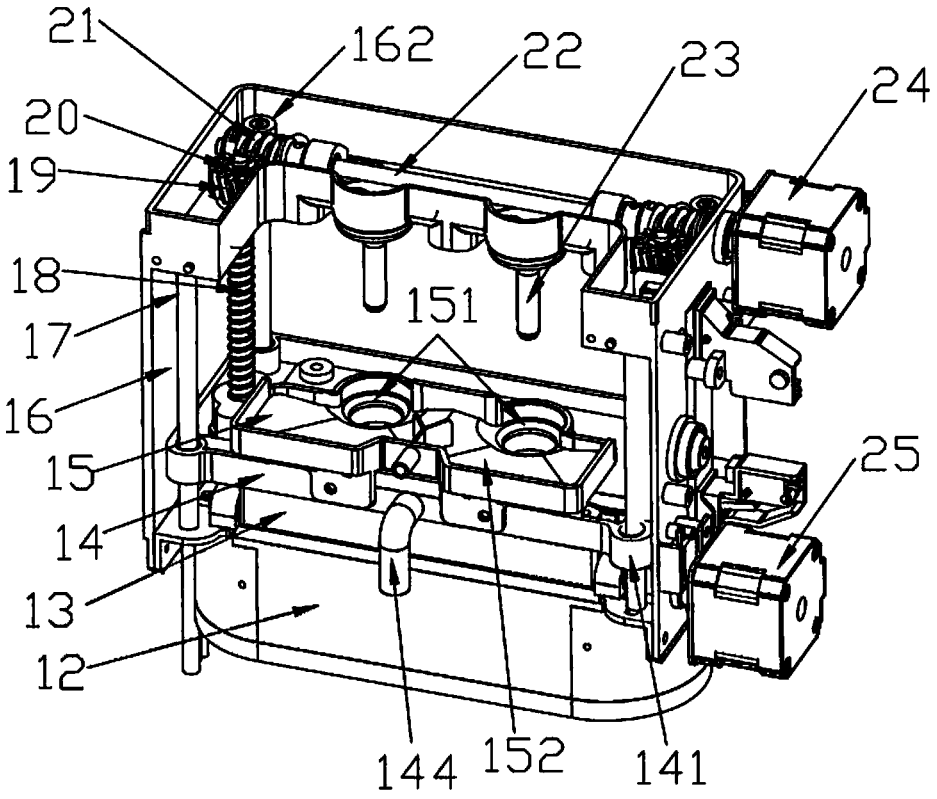
FIG. 6 is a schematic view of the ice making module in Embodiment 1 of the present invention.

To fix the components of the ice making module, the module also includes a bracket. In the present embodiment, as shown in FIG. 6, the bracket includes a U-shaped bracket 16 with a certain height. The U-shaped bracket 16 includes left and right side walls and a rear wall, with the top of these walls forming a top surface.

The lifting motor 24 is fixed to one side wall of the U-shaped bracket 16 via a motor bracket 32. In the present embodiment, the lifting motor 24 and the motor bracket 32 are located on the outside of the right side wall of the U-shaped bracket 16.

The lifting transmission shaft 22 is connected to the output shaft of the lifting motor 24 through the transmission shaft sleeve 36. The transmission shaft sleeve 36 is a hollow shaft, with one end connected to the output shaft of the lifting motor 24 and the other end fitted over the lifting transmission shaft 22. The lifting motor 24 drives the lifting transmission shaft 22 to rotate via the transmission shaft sleeve 36.

The lifting transmission device also includes a friction shaft sleeve 37. To accommodate the transmission shaft sleeve 36, a round hole is provided on the side wall of the U-shaped bracket 16. The friction shaft sleeve 37 is press-fitted into the round hole, and the transmission shaft sleeve 36 rotates within the friction shaft sleeve 37.

The lifting transmission shaft 22 is transversely arranged, and each of the worm gears 21 is a hollow shaft, which are fitted at both ends of the lifting transmission shaft 22. The radial cross-section of the inner cavity of each of the worm gears 21 is non-circular, corresponding to the matching non-circular shape of the sections at both ends of the lifting transmission shaft 22. The right end of the lifting transmission shaft 22 passes through the worm gear 21 and connects with the transmission shaft sleeve 36. For example, the radial section of the worm gear 21 can be two-thirds of a circle, and the middle part of the lifting transmission shaft 22 is cylindrical, while the radial section shape of the two end parts is two-thirds of a circle. The two worm gears 21 are respectively fitted at both ends of the lifting transmission shaft and cooperate with it to prevent the worm gears 21 from slipping relative to the lifting transmission shaft 22. In practical applications, the inner cavity shape of the radial section of the worm gears 21 and the radial section shape of the lifting transmission shaft 22 at both ends can be any shape that can achieve anti-slipping, or corresponding anti-slipping structures can be set between the worm gears 21 and the lifting transmission shaft 22.

To prevent the worm gear 21 from disengaging from the lifting transmission shaft 22 laterally, each end of the lifting transmission shaft 22 is provided with a pin hole 221. The corresponding positions of the worm gears 21 also have pin holes, and a fixing pin 40 is press-fitted into the pin holes 221 to fix the worm gear 21 to the lifting transmission shaft 22 and make them rotate together.

Figure 9:
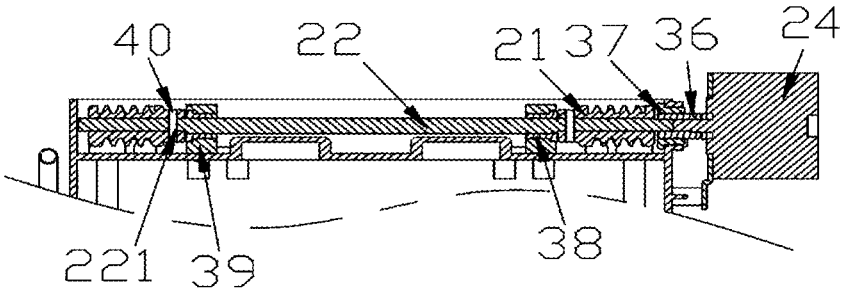
FIG. 9 is a cross-sectional schematic view of the lifting structure of the ice making module according to the present invention.

The lifting transmission device also includes two sets of matching upper bearing seats 39 and upper bearings 38. As shown in FIG. 9, each of the upper bearing seats 39 is fixed on the top surface of the bracket. The upper bearing 38 is press-fitted into the upper bearing seat 39, and the lifting transmission shaft 22 rotates within the upper bearings 38, thus fixing the lifting transmission shaft 22 on the top surface of the U-shaped bracket 16. In the present embodiment, two sets of upper bearing seats 39 and upper bearings 38 are located between the two worm gears 21. In practical applications, multiple sets of upper bearing seats 39 and upper bearings 38 can be provided between the two worm gears 21 to provide fixed support and to prevent deformation of the worm gear 21 under gravity, which could affect transmission and cause uneven motion at both ends.

The lifting transmission device also includes two or more screw rods 18 set vertically and evenly on both sides of the upper mold 26. In the present embodiment, there are two screw rods 18.

Figure 7:
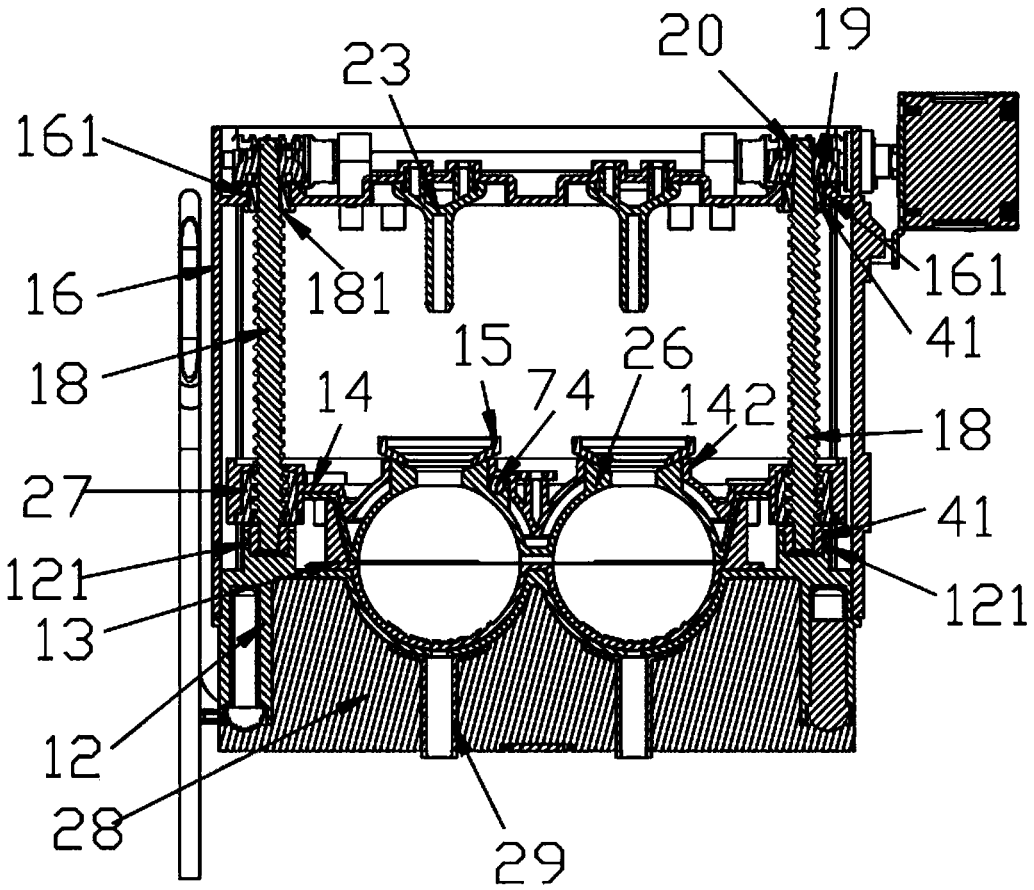
FIG. 7 is a cross-sectional schematic view of the ice making module according to the present invention.

As shown in FIG. 7, the top surface of the U-shaped bracket 16 has two shaft sleeve holes 161, each of the shaft sleeve holes 161 containing a shaft sleeve 41. The upper ends of the two screw rods 18 are inserted into the shaft sleeves 41. The shaft sleeves 41 are press-fitted from bottom to top into the shaft sleeve holes 161, and the upper ends of the screw rods 18, after passing through the shaft sleeves 41, are inserted into the central holes of the worm wheels 19. The worm wheels 19 are fixed at the top positions of the screw rods 18, making the worm wheels 19 drive the screw rods 18 to rotate together. The tops of the screw rods 18 extend beyond the shaft sleeves 41, and the extended parts have a radial cross-section of two-thirds of a circle. The central holes of the worm wheels 19 also have a radial cross-section of two-thirds of a circle, fixing the worm wheels 19 at the tops of the screw rods 18 and providing anti-rotation limits, preventing the screw rods 18 from idling within the central holes of the worm wheels 19. The upper segments of the screw rods 18 are stepped shafts, with the bottoms of the worm wheels 19 contacting the steps to limit the downward movement of the worm wheels 19. The tops of the screw rods 18 have open retaining rings 20, which prevent the worm wheels 19 from moving upwards. The screw rods 18 have limit steps 181, with the top surfaces of the limit steps 181 abutting the bottom surfaces of the shaft sleeves 41 mounted on the top surface of the bracket.

By setting worm wheels 19 at the tops of each screw rod 18 to mesh with the worm gears 21 on the lifting transmission shaft 22, the horizontal rotation output of the lifting motor 24 is converted into the vertical rotation of the screw rods 18. When the output shaft of the lifting motor 24 rotates, it drives the lifting transmission shaft 22 and the worm gears 21, which in turn drive the worm wheels 19 and screw rods 18 to rotate.

In the present embodiment, the lifting motor 24 has a single-shaft output, driving one lifting transmission shaft 22. Through the meshing worm wheels 19 and worm gears 21 at both ends of the lifting transmission shaft 22, two screw rods 18 are driven to rotate synchronously. In practical applications, based on the weight of the upper mold 26 to be driven and the power of the lifting motor 24, a lifting motor 24 with dual or multiple shaft outputs can be used, with each output shaft connected to one lifting transmission shaft 22, simultaneously driving four or more screw rods 18 to rotate synchronously and moving the upper mold 26 up and down.

In the present embodiment, an upper cover 11 is installed above the top surface of the U-shaped bracket 16. The upper cover protects the lifting transmission shaft 22, the worm gears 21, the worm wheels 19, the upper bearing seat 39, and the upper bearing 38 from water ingress and prevents accidental contact that could cause injury.

As shown in FIG. 7, the heat transfer block 12 features two positioning hollow shafts 121, with two shaft sleeves 41 press-fitted and fixed within the hollow shafts. The lower ends of the two screw rods 18 are inserted into the shaft sleeves 41 on the heat transfer block 12 and can rotate relative to them.

Each end of upper mold fixing component 14, located in the middle of the front-to-back direction, is provided with a through-hole containing a nut 27. The external threads of the screw rod 18 and the internal threads of the nut 27 form a threaded connection, converting the rotational movement of the screw rod 18 into the linear lifting movement of the nut 27. The nut 27 is fixed to the upper mold fixing component 14, which in turn is fixed to the upper mold 26, thus enabling the upper mold 26 to move vertically along the screw rod 18 with the nut 27.

To ensure that the upper mold fixing component 14 moves straight up and down without tilting, as shown in FIG. 6, four guide holes 141 are provided at the four corners of the upper mold fixing component 14. Each of the guide holes 141 contains a guide rod 17, with the bottom of each guide rod 17 fixed to the heat transfer block 12, and the top inserted and fixed into the guide hollow columns 162 on the top surface of the bracket. These arrangements allow the upper mold fixing component 14 to move up and down along the guide rods 17 without tilting.

In other embodiments, the positions and number of guide holes 141 and guide rods 17 can be adjusted as needed, ensuring that the upper mold fixing component 14 moves straight up and down.

The upper mold 26 is either screwed to the bottom of the upper mold fixing component 14 or integrated with it, serving as a reinforcing structure around the ice making cavities to provide fixed connection and strength. The screw rod 18 is threaded to a nut 27 located in this reinforced structure. The upper mold 26 and the lower mold 13 combine to form multiple cavities, which serve as the spaces for ice formation. These cavities can be designed in various shapes as required. They can be a single cavity, a row of multiple cavities, or multiple rows of cavities to produce ice blocks in specific shapes.

Figure 13:
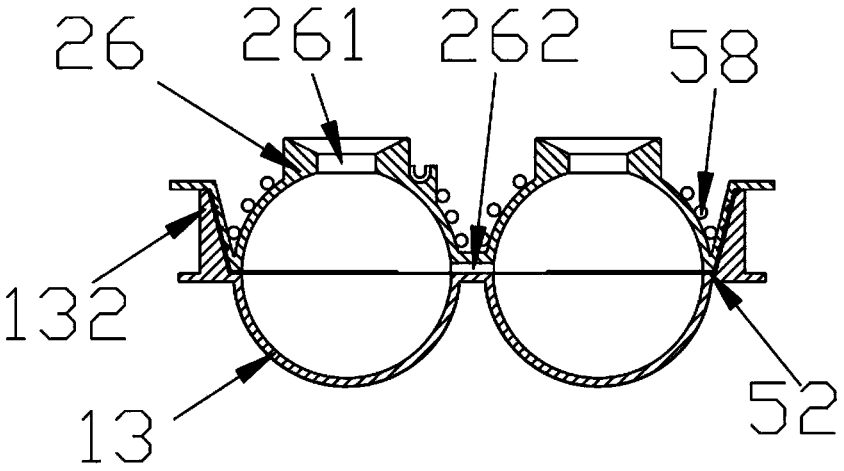
FIG. 13 is an enlarged cross-sectional view of the upper and lower molds of the ice making module according to the present invention.

In this embodiment, two spherical chambers are formed between the upper mold 26 and the lower mold 13 in a fitting manner. These chambers serve as the accommodation space for ice cubes, with the horizontal plane containing the spherical center being the dividing line between the upper mold 26 and the lower mold 13. Therefore, the main parts of the upper mold 26 and the lower mold 13 each have two hemispherical ice-making cavities. As shown in FIG. 13, there is a water inlet holes 261 above each hemispherical chamber of the upper mold 26. As shown in FIG. 7, correspondingly, the upper mold fixing component 14 has avoiding holes 142 to accommodate the water inlet holes 261, allowing water to flow from the water distribution tank 15 into the cavities formed between the upper mold 26 and lower mold 13.

As shown in FIG. 6, the water distribution tank 15 is fixed above the upper mold fixing component 14. The water distribution tank 15 has two water inlet channels 152, and a water inlet funnel 151 provided at the end of the water inlet channel 152 correspondingly rests on the top surface of the water inlet holes 261. When water flows into the distribution tank 15, it travels along the water inlet channels 152 into the water inlet funnels 151, through the water inlet holes 261, and finally into the mold cavities formed by the upper and lower molds.

Figure 11:
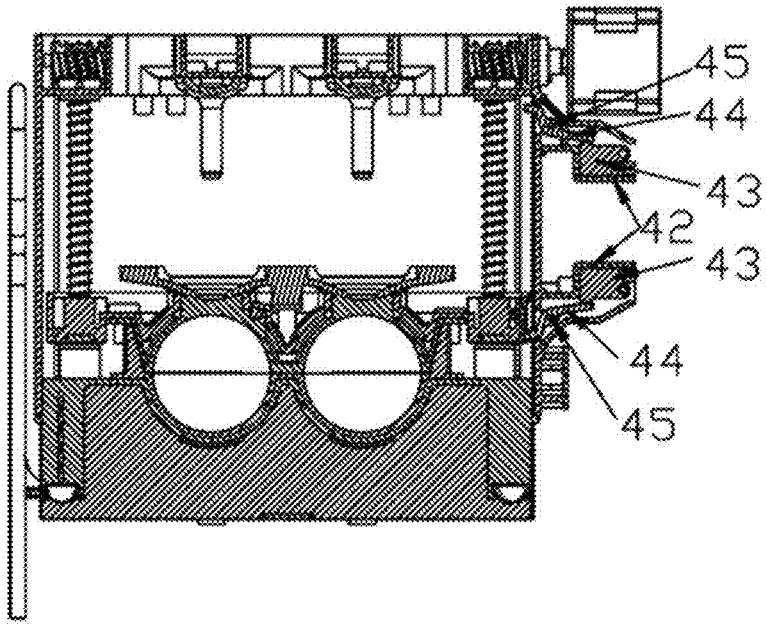
FIG. 11 is a cross-sectional schematic view of the upper and lower limit structures of the ice making module according to the present invention.

As shown in FIG. 7 and FIG. 11, ice breaking components 23 is fixed below the top surface of the bracket, directly above the water inlet holes 261 of the upper mold 26. The ice breaking components 23 correspond in number to the water inlet holes 261 and can insert into them when the upper mold 26 rises to a certain height, knocking off any ice that remains on the upper mold 26 into the corresponding cavities of the lower mold 13.

Figure 12:
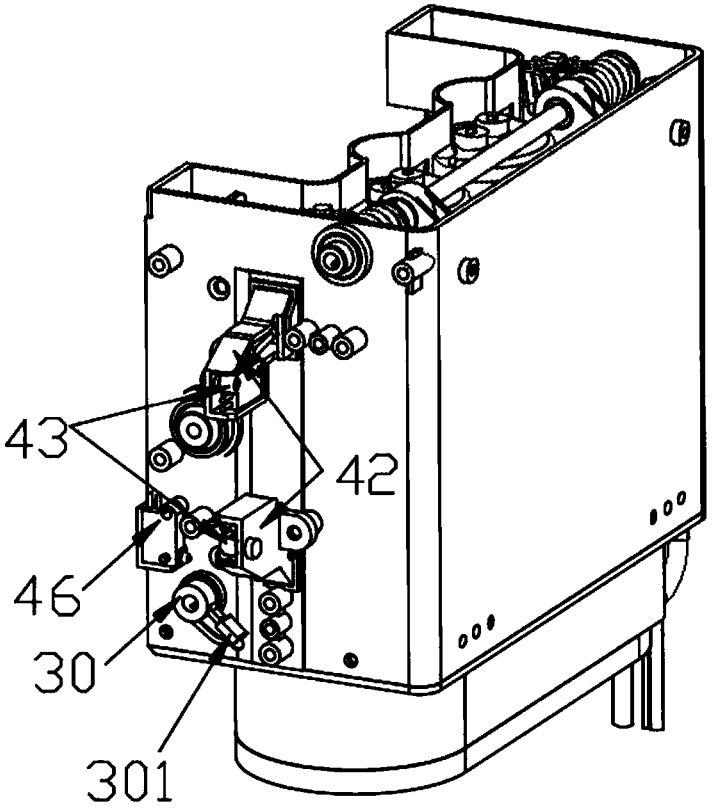
FIG. 12 is a schematic view of the upper and lower limits of the ice making module according to the present invention.

Combining the illustrations shown in FIG. 11 and FIG. 12, to restrict the upward and downward positions of the upper mold 26, upper and lower limit devices are installed. The upper and lower limit devices include an upper limit device and a lower limit device, both of which have the same structure and are fixed along the vertical direction on the side walls of the U-shaped bracket 16.

The upper limit device includes a limit sensor 43, a sensor bracket 42, a limit lever 44, and a lever shaft 45. The limit sensor 43 is fixed to the sensor bracket 42 with screws. The limit lever 44 is fixed to the sensor bracket 42 via the lever shaft 45 and can rotate around the shaft. One arm of the limit lever 44 can contact or separate from the contacts of the limit sensor 43. The sensor bracket 42 is fixed to the outer side wall of the U-shaped bracket 16 with screws. Avoidance square hole are opened on the side walls of the U-shaped bracket 16, and the other lever arm of the limiting lever 44 extends into the side wall of the U-shaped bracket 16 through the square hole.

The lower limit device is symmetrically arranged with the upper limit device.

In a mold-closing state, the limit lever 44 of the lower limit device contacts the contacts of the limit sensor 43, while the limit lever 44 of the upper limit device separates from the contacts of the limit sensor 43. When the upper mold 26 moves upward, the limit lever 44 of the lower limit device separates from the contacts of the limit sensor 43 until the top surface of the upper mold fixing component 14 touches the lever arm of the limit lever 44 of the upper limit device extending into the side wall of the U-shaped bracket 16, causing the other lever arm to contact the contacts of the limit sensor 43 of the upper limit device, and the upward movement of the upper mold 26 stops. Similarly, when the upper mold 26 moves downward, the limit lever 44 of the upper limit device separates from the contacts of the limit sensor 43, when the upper mold fixing component 14 touches the lever arm of the limit lever 44 of the lower limit device extending into the side wall of the U-shaped bracket 16, the other arm of the limit lever 44 contact the contacts of the limit sensor 43 of the lower limit device, and the downward movement of the upper mold 26 stops, and the mold closing is completed.

Figure 10:
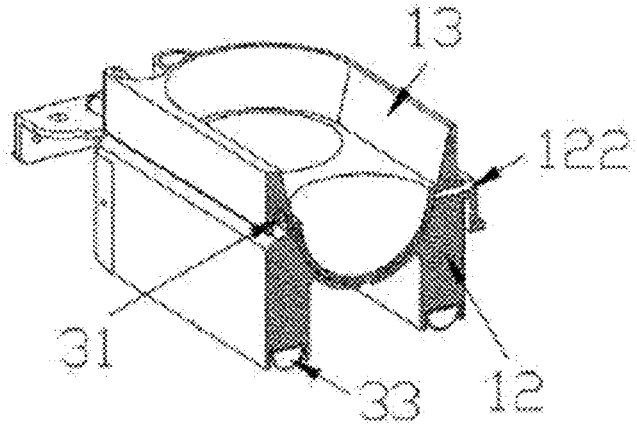
FIG. 10 is a schematic view of the ventilation holes in the heat transfer block of the ice making module according to the present invention.

On the walls between the cavities of the upper mold 26, a water level balancing channel 262 is provided to connect adjacent cavities, ensuring equal water volume in each ice block. The water level balancing channel 262 is established between adjacent cavities, so that after the upper mold 26 and the lower mold 13 are closed, the water volume in the cavities on the left and right sides is the same, resulting in ice blocks of the same volume. As shown in FIG. 10 and FIG. 13, the connecting walls between adjacent cavities of the upper mold 26 are equipped with upwardly curved structures, or the height of the connecting walls is lower than the bottom wall of the cavities on the outer side of the lower mold 13 when closed. After closing, the water level balancing channel 262 is formed at corresponding positions between adjacent cavities of the upper mold 26 and the lower mold 13, with a small height, approximately 1.5-3.5 mm. To prevent water from being affected by surface tension and flowing slowly, in the present embodiment, the height of water level balancing channel 262 is 2.5 mm. Ice formed here can detach from the ice block during demolding, without affecting the overall shape of the ice block or the water balance in each chamber during the next water injection. To prevent water from flowing out from the joint gap between the upper mold 26 and the lower mold 13, the bottom edge of the upper mold 26 is equipped with rubber scaling strip 52, which are directly injection molded onto the surface of the upper mold 26. When the upper mold 26 and the lower mold 13 are closed, the rubber scaling strip 52 are squeezed between the upper and lower molds, preventing water from flowing out of the gap.

To prevent the rubber sealing strip 52 from failing and water from leaking out of the gap between the upper and lower molds causing equipment malfunctions, the lower mold 13 also includes a surrounding barrier 132. The surrounding barrier 132 is located around the perimeter of the ice making chamber of the lower mold 13, and after the lower mold 13 and the upper mold 26 are closed, the surrounding barrier 132 is positioned on the outer side of the wall of the chamber formed by the upper and lower molds. The height of the surrounding barrier 132 is higher than the normal water level for making ice, and around the perimeter of the ice making chamber of the upper mold 26, an inverted L-shaped stopper is installed. The vertical side of the stopper aligns with the side of the surrounding barrier 132, with a sealing rubber strip placed at the junction, while the top horizontal side of the stopper overlaps with the top of the surrounding barrier 132. Since the amount of water injected into the mold is fixed, even if the rubber scaling strip 52 fail, according to the principle of continuity, the water will be confined within the space enclosed by the surrounding barrier 132 and the stopper, preventing equipment malfunctions.

Figure 8:
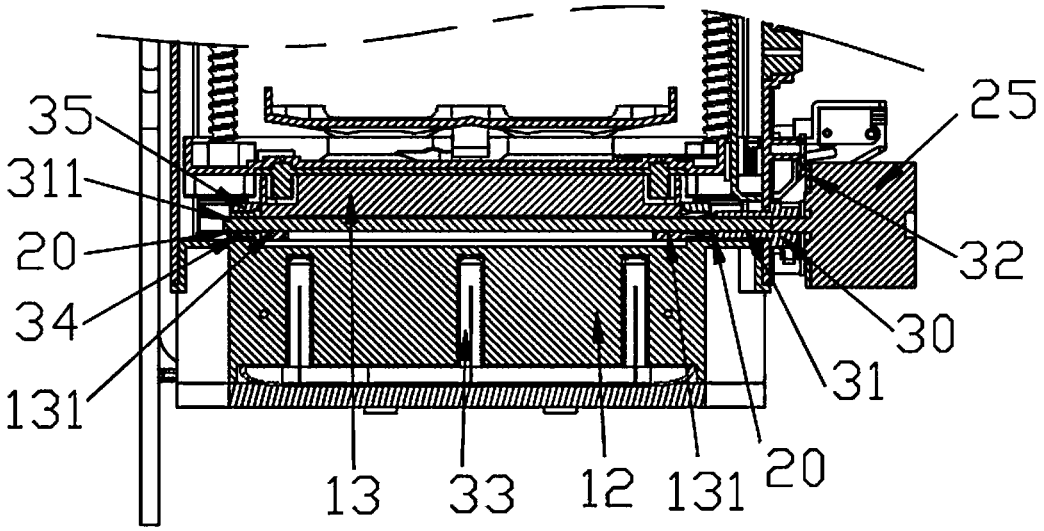
FIG. 8 is a cross-sectional schematic view of the flipping structure of the ice making module according to the present invention.

In the present embodiment, the ice release mechanism includes a flipping device that drives the lower mold 13 to flip and release the ice after the upper mold 26 rises. The flipping device comprises a flip motor 25, a flip transmission device, and a flip limit device. As shown in FIG. 8, the flip transmission device includes a flipping connecting rod 31 and a flipping control component 30. One end of the flipping connecting rod 31 is fixed to the output shaft of the flip motor 25 via the flipping control component 30, which also acts as a flipping limit sensor 46 to control the flip angle and direction of the flip motor 25. The other end of the flipping connecting rod 31 is connected to the lower mold 13.

Alternatively, the flipping device comprises a flip motor 25, a flip transmission device, and a flip limit device. The flip transmission device includes a flipping connecting rod 31 that connects to the lower mold 13, driving it to flip. One end of the flipping connecting rod 31 is fixed to the output shaft of the flip motor 25, and the flipping control component 30 and flipping limit sensor 46 work as the flip limit device, controlling the flip angle and direction of the flip motor 25 by being connected to either the output shaft of the flip motor 25 or the flipping connecting rod 31.

In the present embodiment, the structure is as follows:

The front lower side or the bottom front side of the lower mold 13 is connected to the flipping connecting rod 31, or the flipping connecting rod 31 is connected at an angle space between the front side and the bottom of the main structure of the lower mold 13. Either connection method drives the lower mold 13 to flip. As shown in FIG. 8 and FIG. 10, there are two fixed holes 131 at the left and right ends of the front side wall of the lower mold 13, and an opening in the middle of the bottom of the front side wall forms a half-through slot with an open bottom, which is axially connected with the two fixed holes 131 on the left and right sides. The flipping connecting rod 31 penetrates the axial channel formed by the left and right fixed holes 131 and the half-through slot on the front side wall of the lower mold 13, with both ends of the flipping connecting rod 31 extending out from the fixed holes 131 on the left and right sides of the lower mold 13. The radial cross-section of the fixed holes 131 is two-thirds circular, and the radial cross-section of the flipping connecting rod 31 is also two-thirds circular. This shape restricts their relative circumferential movement, so when the flipping connecting rod 31 rotates, it drives the lower mold 13 to rotate together.

Two lower bearings 34 are sleeved on the flipping connecting rod 31 and are located on the left and right sides of the lower mold 13, specifically on the parts of the flipping connecting rod 31 extending from the fixed holes 131 on the left and right sides of the lower mold 13. On the outer sides of the left and right lower bearings 34, an open retaining ring 20 is set into the limit grooves 311 of the flipping connecting rod 31, thereby fixing the lower bearings 34 and the lower mold 13 on the flipping connecting rod 31 to prevent relative axial movement.

The lower bearings 34 are press-fitted into the lower bearing seats 35, which are fixed to the heat transfer block 12 by screws, thus fixing the flipping connecting rod 31 to the heat transfer block 12 and allowing it to maintain circumferential rotational movement within the lower bearings 34.

The flipping motor 25 is fixed to the U-shaped bracket 16 through the motor bracket 32. In the present embodiment, the flipping motor 25 and the motor bracket 32 are fixed to the outer side of the right side wall of the U-shaped bracket 16.

The free end of the output shaft of the flipping motor 25 has a radial cross-section shaped like two-thirds of a circle, and the section of the output shaft of the flipping motor 25 near the motor body is cylindrical.

As shown in FIG. 8 and FIG. 12, the flipping control component 30 is sleeved on the output shaft of the flipping motor 25, with one end fixed to and rotating with the output shaft of the flipping motor 25. The other end of the flipping control component 30 is fixedly sleeved with the flipping connecting rod 31. The flipping control component 30 includes a hollow shaft and a rotating arm 301, with the rotating arm 301 sleeved around the outer circumference of one end of the hollow shaft and extending away from the central axis. The inner cavity of the hollow shaft has a radial cross-section roughly shaped like two-thirds of a circle, corresponding to the radial cross-sections of the output shaft of the flipping motor 25 and the flipping connecting rod 31, forming an anti-rotation limit. As shown in FIG. 8, a through-hole is open on the right side wall of the U-shaped bracket 16, and after passing through this through-hole, the flipping control component 30 is fixedly connected to the right end of the flipping connecting rod 31. The hollow shaft of the flipping control component 30 serves to bridge the output shaft of the flipping motor 25 and the flipping connecting rod 31. When the output shaft of the flipping motor 25 rotates, it drives the flipping control component 30 to rotate, thereby causing the flipping connecting rod 31 to rotate the lower mold 13. In practical applications, the hollow shaft may be omitted, and the flipping connecting rod 31 can be directly fixed to the output shaft of the flipping motor 25, with the rotating arm fixedly sleeved on the flipping connecting rod 31 or the output shaft of the flipping motor 25.

As shown in FIG. 8 and FIG. 12, the flipping limit sensor 46 is fixed on the U-shaped bracket 16. In the present embodiment, the flipping limit sensor 46 is fixed to the outer side of the right side wall of the U-shaped bracket 16. When the output shaft of the flipping motor 25 drives the flipping control component 30, the flipping connecting rod 31, and the lower mold 13 to rotate together, the rotating arm 301 on the flipping control component 30 stops the flipping movement when it touches the flipping limit sensor 46.

As shown in FIG. 7 and FIG. 10, the heat transfer block 12 is made of a material with good thermal conductivity, in the present embodiment, aluminum. The heat transfer block 12 is located below the lower mold 13 and has side walls and a top wall, with an open bottom. Insulating foam 28 is set within the space enclosed by the side walls and top wall and below the side walls. The lower mold 13 sits on top of the heat transfer block 12, with the top wall of the heat transfer block 12 in close contact with the bottom of the lower mold 13. The bottom of the U-shaped bracket 16 is fixed to the heat transfer block 12.

As shown in FIG. 7, FIG. 8, and FIG. 10, multiple vertical deep holes are opened within the side walls of the heat transfer block 12, and a groove with a bottom opening is set at the bottom end of the side walls to connect the vertical deep holes. The evaporator 33 is connected to the heat transfer block 12 through the groove and vertical deep holes, with the pipeline of the evaporator 33 tightly fitting in the groove and vertical deep holes of the heat transfer block 12, enabling rapid heat conduction from the evaporator 33 to the heat transfer block 12 for quick ice making. The insulating foam 28 below the side walls of the heat transfer block 12 seals the bottom openings of the grooves at the bottom end of the side walls, preventing cold loss.

The cooperation method between the heat transfer block 12 and the evaporator 33 can vary, with the aforementioned connection being just one example. The invention covers the heat transfer block 12 cooperating with the evaporator 33 to act as a heat transfer medium, quickly conducting heat between the evaporator and the mold. Therefore, any method that achieves rapid heat conduction between the heat transfer block 12 and the evaporator 33 is within the protection scope of the present invention. In other embodiments, a through-hole can be set in the heat transfer block 12, with the evaporator's pipe passing through the through-hole, or the evaporator 33 can be wrapped around the outside of the heat transfer block 12 to achieve their cooperation.

According to the principle of heat transfer, when the evaporator 33 cools, it transfers the cold to the heat transfer block 12. Since the main structures of the upper mold 26 and lower mold 13 (especially the walls of the ice making chamber) are made of aluminum, and the lower mold 13 is in close contact with the heat transfer block 12, the cold quickly conducts to the lower mold 13 and upper mold 26.

Thus, the water in the chambers freezes into ice blocks quickly, achieving rapid ice making.

After the ice making process is completed, a very thin layer of ice will condense on the surfaces of the heat transfer block 12 and the lower mold 13, and in the mating gaps. The ice blocks will also adhere to the surface of the mold. To facilitate the demolding of the ice blocks, at this time, the evaporator 33 switches from cooling to heating. Heat is transferred through the heat transfer block 12 to both the lower mold 13 and the upper mold 26. The surface of the ice blocks begins to melt, no longer sticking to the mold. Meanwhile, the ice on the surfaces of the heat transfer block 12 and the lower mold 13, as well as in the mating gaps, melts into water. The water forms surface tension in the assembly gaps of the heat transfer block 12 and the lower mold 13, causing the lower mold 13 to adhere to the heat transfer block 12. To eliminate this surface tension, as shown in FIG. 10, there are ventilation holes 122 on the heat transfer block 12. These holes are connected to the gap between the top surface of the heat transfer block 12 and the bottom surface of the lower mold 13. Air enters the gaps between the heat transfer block 12 and the lower mold 13 through the ventilation holes 122, eliminating the surface tension between the heat transfer block 12 and the lower mold 13, making it easier for the lower mold 13 to flip. To drain the melted water, drainage outlets are set at the lowest point of the top wall of the heat transfer block 12. In the present embodiment, there are two circular drainage outlets at the corresponding top wall of the heat transfer block 12 at the bottom of the two ice blocks. Below the drainage outlets, drainage funnels 29 are installed to collect the water flowing down from the drainage outlets. The drainage funnels 29 penetrate the upper and lower parts of the insulation foam 28.

To prevent the contact time between the lower mold 13 and the heat transfer block 12 transformed to the heat source state from being too long as demolding after ice blocks are made, which results in excessive heat transfer and rapid melting of the ice block, a lifting device serving as a separation device is installed on the heat transfer block 12. The lifting device presses against the bottom of the rear part of the lower mold 13, facilitating rapid separation between the lower mold 13 and the heat transfer block 12.

Figure 18:
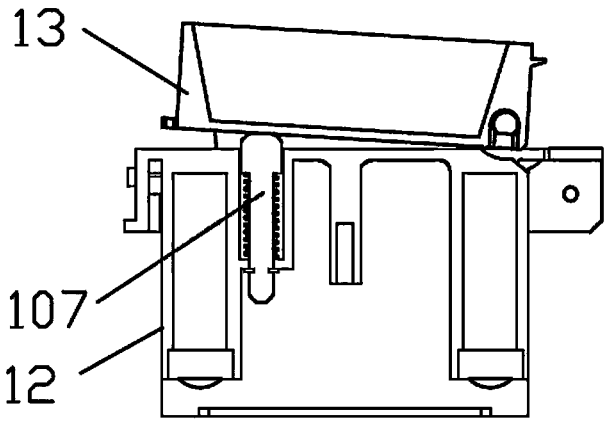
FIG. 18 is a schematic view of the lifting device according to the present invention.

In the present embodiment, as shown in FIG. 18, the lifting device includes a top pillar 107, a spring, and a snap ring. In the space enclosed by the side wall and the top wall of the heat transfer block 12, a longitudinally extending deep hole is open on the top wall of the heat transfer block 12, with a small hole set on the bottom wall of the hole. A T-shaped top pillar 107 is sleeved with a spring and set in the longitudinally extending deep hole. The bottom end of the T-shaped top pillar 107 passes through the small hole set on the bottom wall of the hole and a snap ring is set on the outer side of the bottom end of the T-shaped top pillar 107. The snap ring limits the T-shaped top pillar 107 from completely coming out upward.

When the upper and lower molds are closed, the lower mold 13 presses down the T-shaped top pillar 107, causing the T-shaped top pillar 107 to move downward, compressing the spring. The top of the T-shaped top pillar 107 enters the longitudinally extending deep hole, causing the lower mold 13 to fit with the heat transfer block 12. When opening the mold, the upper mold 26 moves upward. Since the upper mold 26 no longer applies pressure to the lower mold 13, the T-shaped top pillar 107 moves upward under the action of the spring force. It pushes out from the longitudinally extending deep hole, thereby lifting the lower mold 13 away from one side of the flipping connecting rod 31, causing the bottom of the lower mold 13 to be in a tilted state, forming a certain angle with the surface of the heat transfer block 12, reducing the contact area. These arrangements prevent the lower mold 13 from staying in contact with the heat transfer block 12 for too long during ice block formation, which would lead to excessive heat transfer and too rapid melting of the ice blocks, effectively maintaining the overall shape of the ice blocks.

The lifting device and the ventilation holes 122 can be provided individually or simultaneously. In the present embodiment, both the lifting device and the ventilation holes 122 are set simultaneously to ensure rapid separation between the lower mold 13 and the heat transfer block 12 after ice making, making it easier for subsequent demolding and flipping of the lower mold 13. At the same time, rapid separation of the lower mold 13 from the heat source-transformed heat transfer block 12 prevents excessive melting of the lower part of the ice blocks, maintaining the shape of the ice blocks and avoiding the phenomenon where the upper diameter of spherical ice blocks is larger than the lower diameter at the mold parting line.

In other embodiments, other structures can be used as separation devices, as long as they achieve the purpose of quickly separating the lower mold 13 from the heat transfer block 12 after the upper mold 26 rises.

During the demolding of ice, as the heat from the upper mold 26 is transmitted through the heat transfer block 12 and the lower mold 13, it takes a certain amount of time for the heat to conduct from the bottom to the top of the ice making chamber. Additionally, there will be a temperature difference between the upper mold 26 and the lower mold 13. The melting rate of the ice blocks inside the lower mold 13 is greater than that inside the upper mold 26, which can lead to deviations in the overall size of the ice blocks. When the heat conduction time is insufficient and the temperature of the upper mold 26 is not high enough, the lower part of the ice blocks may have already melted while the upper part remains not melted or partially melted.

At this point, when the lower mold 13 begins to flip, the ice blocks will not detach from the surface of the upper mold 26. To address this issue, as shown in FIG. 13, heating wires 58 are attached to the outer surface of the upper mold 26 to provide auxiliary and compensatory heating to the ice making chamber of the upper mold 26. Additionally, as shown in FIG. 7, there is a temperature sensor 74 on the top surface of the upper mold 26 to detect the surface temperature of the upper mold 26. The power of the heating wires 58 can be calculated through big data analysis of the temperature rise rate of the upper mold 26 and the lower mold 13 from the end of the ice making process to the flipping process.

The upper mold 26 and the lower mold 13 can be made of food-grade stainless steel, aluminum, or other materials with high thermal conductivity. Additionally, considering that molds made of aluminum or other materials may pose certain hazards to human health, food-grade silicone parts can be added to the upper mold 26 and the lower mold 13, respectively, within the cavities formed by the upper and lower molds to wrap around all the ice blocks, preventing direct contact between the ice blocks and the mold material to prevent harm to human body. The thickness of the food-grade silicone parts should be as thin as possible while ensuring structural strength to avoid affecting thermal conductivity.

The ice making module also includes a quantitative water supply system. The quantitative water supply system includes a quantitative water box 7, a solenoid valve 8, and a water pipe.

Figure 5:
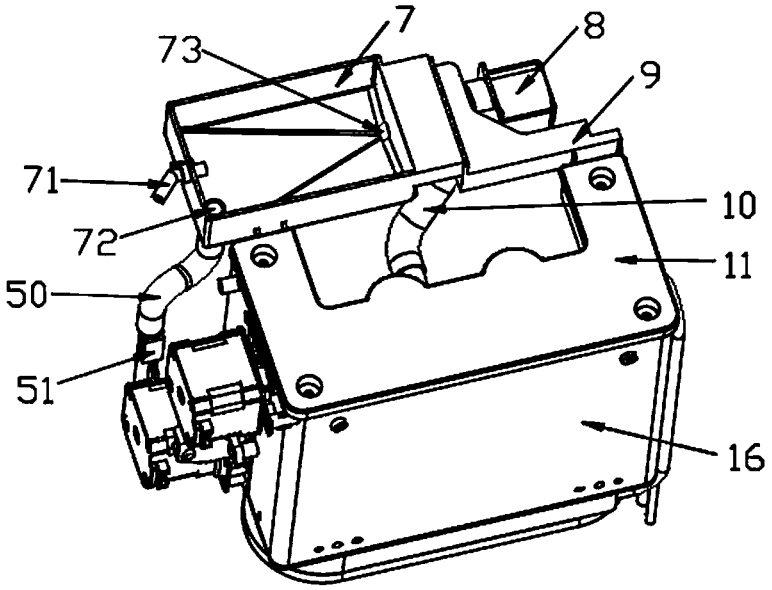
FIG. 5 is a schematic view of the quantitative water storage in the ice making module in Embodiment 1 of the present invention.

As shown in FIG. 5, a solenoid valve bracket 9 is roughly L-shaped, with one end fixed to the solenoid valve 8 and the quantitative water box 7, and the other end fixed to the U-shaped bracket 16 with screws. The lower part of the quantitative water box 7 is also fixed on the top surface of the bracket with screws, securing both the solenoid valve 8 and the quantitative water box 7.

As shown in FIG. 5, the quantitative water box 7 has a water inlet 71 for filling water into the quantitative water box 7.

The quantitative water box 7 is equipped with a drainage outlet 72, which is a hollow pipe with a certain height set as an overflow outlet in the quantitative water box 7, as shown in FIG. 5, set at a corner of the quantitative water box 7, and passing through the bottom wall of the quantitative water box 7. It is connected to a clean water pipe 50 serving as an overflow pipe. When the water level inside the quantitative water box 7 is higher than the height of the drainage outlet 72, excess water in the quantitative water box 7 will be discharged from the drainage outlet 72, ensuring that the water level inside the quantitative water box 7 remains constant. This water volume is precisely equal to the total water volume required to make multiple ice blocks. Moreover, a sensor is installed on the pipeline connected to the drainage outlet 72 as a quantitative water supply detection device. When the sensor detects water flow, the water source will stop filling the quantitative water box 7.

The quantitative water box 7 is also equipped with a water outlet 73, which is connected to the water inlet of the solenoid valve 8 via a water pipe. Combined with FIG. 3 and FIG. 6, the outlet of the solenoid valve 8 is connected to the water inlet of the water distribution tank 15 via an inlet pipe 10. The solenoid valve 8 controls the quantitative water supply, further realizing the function of quantitatively introducing water into the ice making cavity.

During ice making, when the upper and lower molds are closed, the quantitative water supply system injects a certain amount of water into the ice making cavity formed after mold closure. The water volume is precisely equal to the amount of water required to make the ice blocks. Thus, there is no excess water inside the quantitative water box 7 when the mold is closed and filled with water. The water distribution tank 15 evenly distributes the water volume to each ice making cavity, allowing for the production of multiple ice blocks of the same volume. The rubber sealing strip 52 is used to seal the upper mold 26 and the lower mold 13 to prevent water overflow. The lower mold 13 has a surrounding barrier 132 that prevents water from spilling out when the rubber sealing strip 52 fails. The evaporator 33 cools down, quickly transferring cold energy through the heat transfer block 12 to the lower mold 13 and the upper mold 26, thereby rapidly freezing the water in the ice making cavity into ice blocks. After ice making is completed, the fixed upper mold fixing component 14 and the upper mold 26, which are integrated structures, move upward along the screw rod 18 and guide rod 17 as a whole under the action of the lifting motor 24 and the lifting transmission device. The lifting device quickly lifts the lower mold 13, separating it from the heat transfer block 12. As the upper mold 26 moves upward, the ice breaking components 23 inserted into the water inlets 261 causes the ice blocks remaining in the upper mold 26 to fall into the lower mold 13. After the upper mold 26 has moved a certain distance upward and stopped, the flipping motor 25 starts to work. The flipping transmission device drives the lower mold 13 to rotate to a certain angle and then stops rotating. The ice blocks fall from the lower mold 13 under gravity. After the ice blocks slide off, the flipping motor 25 reverses to drive the lower mold 13 to reset, while the upper mold 26 descends to reset, allowing for ice making to begin again. This process is simple, convenient, and allows for precise water supply, rapid ice making, and rapid separation of the mold from the heat source. The ventilation holes 122 and the lifting device facilitate the flipping of the lower mold 13. The shape of the ice blocks produced after the upper and lower molds are closed is round, but it can also be any shape that can be demolded, and multiple ice block shapes can be set on the same set of molds, with characters and patterns set on the walls of the ice making cavity, allowing the surface of the ice blocks produced to bear company names and/or logos, etc.

Embodiment 2

An ice making module provided in the present embodiment differs from the one provided in the Embodiment 1 in that the quantitative water supply system is different; the quantitative water box 7, the solenoid valve 8, the solenoid valve bracket 9, and the water inlet pipe 10 are no longer used.

Figure 14:
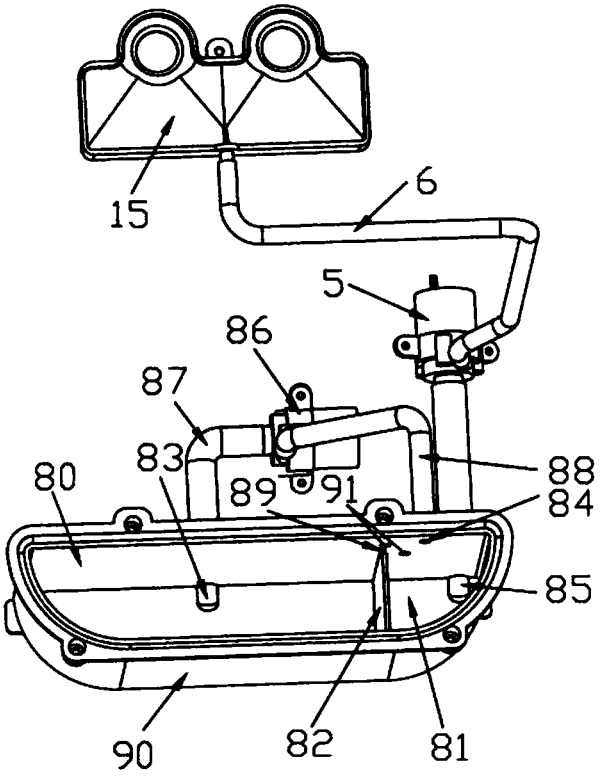
FIG. 14 is a schematic view of the principle of the large and small chambers in the ice making module in Embodiment 2 of the present invention.

In the present embodiment, as shown in FIG. 14, the quantitative water supply system includes a dual-chamber water box 90 and a water pump, as well as water pipes.

The external shape and size of the dual-chamber water box 90 are consistent with a water storage box 4 as in the embodiment 1, and the inside is divided into two chambers by a partition rib 82, with a partition gap 89 set at the upper end of the partition rib 82. The large chamber 80 stores water supplied to the small chamber 81, which serves as a quantitative water box for providing water for ice making.

The bottom of the large chamber 80 has a water outlet 83 of the large chamber, and a water inlet 84 of the small chamber is provided on the top of the small chamber 81, which is higher than the partition gap 89 and/or the partition rib 82. In the present embodiment, the height of the water inlet 84 of the small chamber is slightly higher than that of the partition rib 82. The water outlet 83 of the large chamber is connected to the inlet of the water pump in the water box 86 via an outlet connection pipe 87, and the outlet of the water pump in the water box 86 is connected to the water inlet 84 of the small chamber via a water inlet connecting pipe 88.

The bottom of the small chamber 81 has a water outlet 85 of the small chamber, which is connected to the inlet of the water pump 5. The outlet of the water pump 5 is connected to the water inlet of the water distribution tank 15 via a delivery pipe 6.

When the large chamber 80 is filled with water, the water pump in the water box 86 starts working to draw water from the water outlet 83 of the large chamber and pump it into the small chamber 81 via the outlet connection pipe 87 and the inlet connection pipe 88. If the water level in the small chamber 81 rises above the partition gap 89 on the partition rib 82, water will flow back into the large chamber 80 through the partition gap 89. With these arrangements, the water level in the small chamber 81 will always be maintained at a certain level, which is the amount of water required for making ice blocks.

A water level sensor 91 is provided at the partition gap 89, and another water level sensor 91 is provided on either side wall of the small chamber 81, positioned below the partition gap 89. The two water level sensors 91 serve as a quantitative water supply detection device to jointly determine whether the small chamber 81 is full of water. When the small chamber 81 is filled with water, the water pump in the water box 86 is controlled to stop working. When water is poured into the small chamber 81 from the large chamber 80, the water level gradually rises and submerges one of the water level sensors 91 installed on the wall of the small chamber 81, below the partition gap 89. As water continues to be poured into the small chamber 81, the water level rises until water flows back into the large chamber 80 through the partition gap 89. At this point, the other water level sensor 91 set at the partition gap 89 also detects the water. When both water level sensors 91 detect water, it indicates that the small chamber 81 is filled with water, and the water pump in the water box 86 stops working. Alternatively, the water pump in the water box 86 can be a quantitative pump, controlled to quantitatively pour water into the small chamber based on flow rate and working time.

After the water pump in the water box 86 stops working, the water pump 5 starts working again to draw water from the water outlet 85 of the small chamber, and then water flows directly into the water distribution tank 15 via the delivery pipe 6, finally enters the ice making cavity inside the mold. The present embodiment divides a single water box into two chambers, with the small chamber 81 replacing the quantitative water box 7 used in the Embodiment 1.

Embodiment 3

The present embodiment provides an ice maker, including the ice making module described in the Embodiment 1.

The ice maker also includes a water storage box 4 and a water pump 5.

Figure 3:
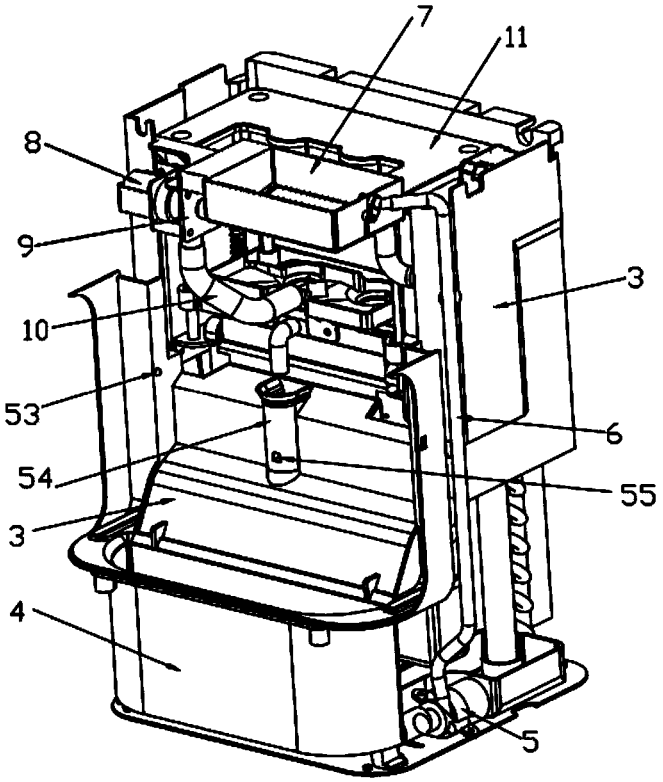
FIG. 3 is a schematic internal structure view of the ice maker in Embodiment 3 of the present invention.
Figure 4:
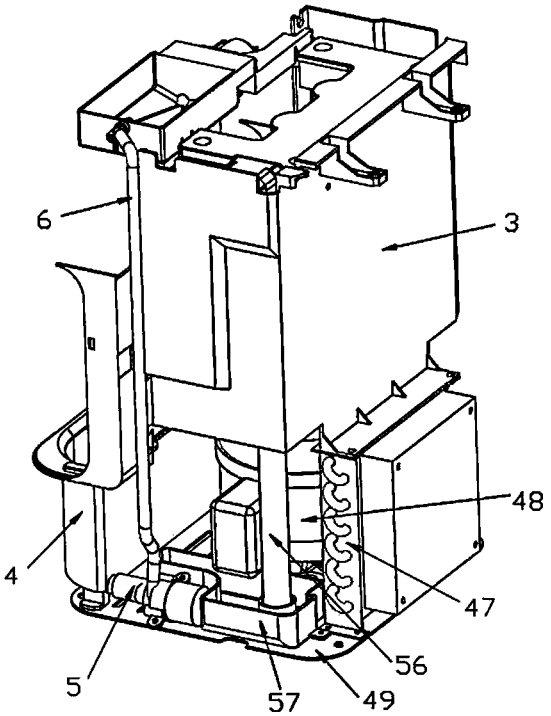
FIG. 4 is a schematic rear structure view of the ice maker in Embodiment 3 of the present invention.

As shown in FIG. 3 and FIG. 4, the water pump 5 is fixed on a base 49. The inlet of the water pump 5 is connected to the bottom outlet of the water storage box 4 via a water pipe, and the outlet of the water pump 5 is connected to the water inlet 71 of the quantitative water box 7 via a delivery pipe 6. Water is supplied from the water storage box 4 to the quantitative water box 7. In practical applications, the water storage box 4 can also be connected to an external water source for water supply.

As shown in FIG. 5, the bottom of the drainage outlet 72 of the quantitative water box is connected to a clean water pipe 50, which ultimately drains water into the water storage box 4. An inductive sensor 51 is set on the surface of the clean water pipe 50. When the inductive sensor 51 detects water flow, the water pump 5 stops working and no longer supplies water to the quantitative water box 7.

The ice making module described in the embodiment 1 is partially installed in the inner liner 3 of the ice maker and fixed with screws.

The ice maker also includes a condenser 47, a compressor 48, the base 49, a drainage pipe 56, a drainage tank 57, an outer shell part 1, a door part 2, an ice receiving basket 59, ice sensors 53, and a water collection box 54. The installation connection is as follows:

The condenser 47 is fixed on the base 49 with screws, and the compressor 48 is also fixed on the base 49 with screws and is located below an inner liner 3. The back bottom of the inner liner 3 is supported on the top surface of the condenser 47, and fixed together with the condenser 47 with screws, as shown in FIG. 4, the bottom of the rear side wall of the inner liner 3 is provided with an outwardly bent flat plate, which is parallel to the base 49. The flat plate is fixed together with the condenser 47 by screws. The compressor 48, condenser 47, and evaporator 33 are connected by pipelines and valves to form a heat exchange system capable of refrigeration and heating. The water storage box 4 is fixed to the front bottom of the inner liner 3 by screws. The left and right sides of the bottom of the water storage box 4 each have a support rib that is supported on the base 49.

As shown in FIG. 4, the back bottom of the inner liner 3 has a bottom outlet, which is connected to the drainage tank 57 fixed on the base 49 via a drainage pipe 56. A drain outlet is provided at the lowest point of the top wall of the aforementioned heat transfer block 12, and a drain funnel 29 is positioned below the drain outlet to receive the water flowing from the drain outlet. The drain funnel 29 passes through the insulating foam 28 to the bottom of the inner liner 3, directing the condensate formed by the heat transfer block 12 to the bottom of the inner liner 3, from where it flows through the drain outlet at the bottom of the inner liner 3 to the drain tank 57. When the compressor 48 is working, the heat generated by the compressor 48 evaporates the wastewater in the drainage tank 57. The condensation water formed by the heat exchange block 12 flows into the drainage pipe 56 and is discharged and is not recycled to the water storage box (4), thereby avoiding contamination of the ice making water source.

The outer shell part 1 is assembled and connected with the inner liner 3, the base 49, and the components on the base 49 through buckles and/or screws, enclosing the inner liner 3, the base 49, and the components on the base 49. To prevent heat loss, thermal insulation foam is filled between the outer shell part 1 and the inner liner 3.

Figure 2:
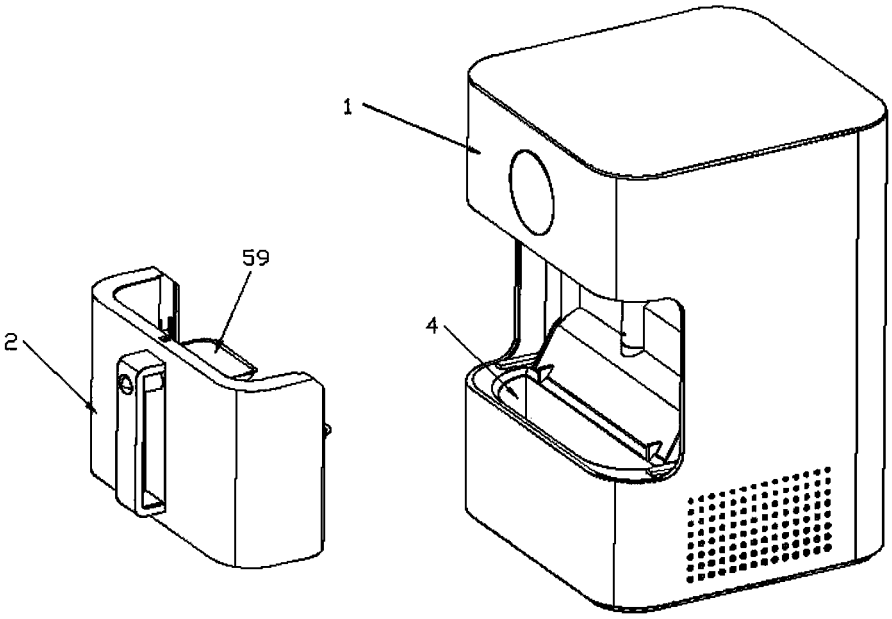
FIG. 2 is a schematic view of the ice maker with the door pulled out according to the present invention.

As shown in FIG. 1 and FIG. 2, the front side of the outer shell part 1 is open, corresponding to the position of the lower mold 13. The door part 2 is installed on the inner liner 3 from the opening and is movably mounted on the inner liner 3. The outer side of the door part 2 forms an integral structure with the outer shell part 1, and the inner side of the door part 2 is provided with an ice receiving basket 59. The door part 2 is installed at the opening of the outer shell part 1 in the inner liner 3. When the lower mold 13 flips, the ice blocks are demolded and fall into the ice receiving basket 59. After pulling out the door part 2 from the opening of the outer shell part 1, the ice blocks inside the ice receiving basket 59 can be taken out.

Figure 19:
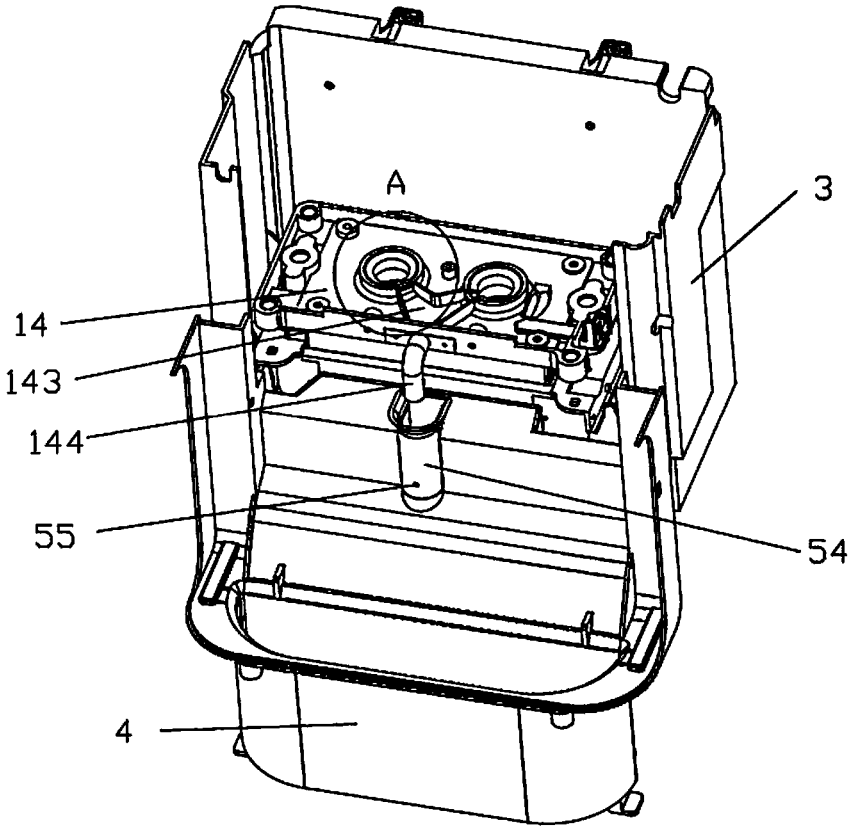
FIG. 19 is a schematic view of the installation of the upper mold fixing component and the water collection box in the ice maker in Embodiment 3 of the present invention.
Figure 20:
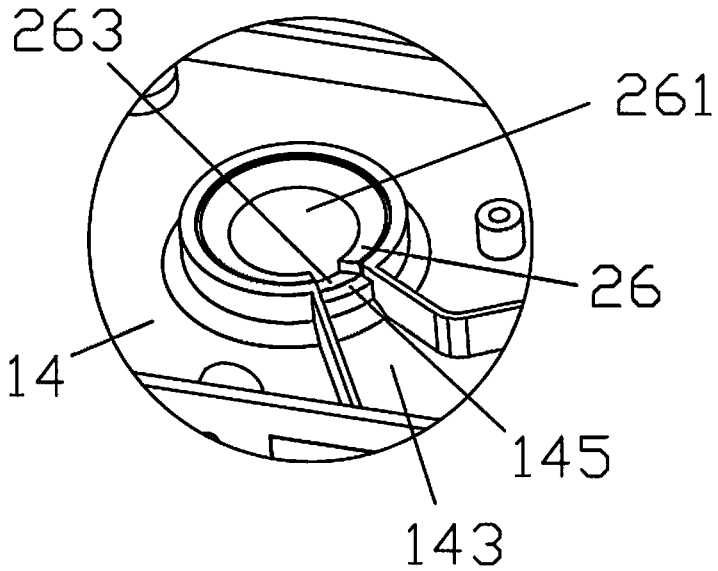
FIG. 20 is a partially enlarged schematic view of FIG. 19.

As shown in FIG. 3, the ice maker also includes two ice sensors 53 to detect whether the ice receiving basket 59 is filled with ice blocks. The two ice sensors 53 are respectively set on the left and right sides of the front part of the inner liner 3, forming a pair, with their heights slightly higher than the top opening of the ice receiving basket 59. When the door part 2 is installed on the inner liner 3 from the opening of the outer shell part 1, the two ice sensors 53 are located on the left and right sides of the ice receiving basket 59 and are above the top opening of the ice receiving basket 59 in the front-rear direction, detecting whether there are ice blocks above the top opening of the ice receiving basket 59. As the lower mold 13 flips, when there may be no ice block falling out of the lower mold 13, the ice blocks may occupy the ice making cavity formed by the upper and lower molds, causing water to overflow from the water inlet holes 261 of the upper mold 26 and soak the equipment. To solve this problem, as shown in FIG. 19 and FIG. 20, a second annular wall is provided at the top of the upper mold 26 to form a water inlet hole 261, the water inlet hole 261 is a through hole, and a second gap 263 is provided at the top of the second annular wall. A first annular wall is provided on the upper mold fixing piece 14 to form an avoiding hole 142, the avoiding hole 142 is a through hole, the second annular wall is coaxially sleeved in the avoiding hole 142, and a sealing ring is provided between the second annular wall and the first annular wall, the first annular wall is provided with a first gap 145 at the top, and the second gap 263 and the first gap 145 correspondingly form a through gap, an overflow pipe 144 is provided on the front side of the upper mold fixing piece 14, and a baffle is provided on the upper mold fixing piece 14, the baffle is provided on both sides of the through gap and extends in a direction away from the water inlet hole 261, and the two baffles enclose to form an overflow channel 143, respectively connecting the first gap 145 and the overflow pipe 144, so that after the water overflows from the water inlet hole 261 of the upper mold 26, it sequentially passes through the second gap 263, the first gap 145, the overflow channel 143, and finally drains out through the overflow pipe 144. The overflow pipe 144 can be connected to the water storage box 4 to recycle the overflow water. As shown in FIG. 19, in the present invention, the two baffles at each through gap are generally "Chinese character eight" shaped and are integrally connected between the two adjacent water inlet holes 261 to prevent the overflow water from flowing out through the gaps between the baffles, making the overflow water only flow towards the overflow pipe 144, which is conducive to the collection and reuse of the overflow water, preventing the overflow water from flowing into the motor or other electrical components and damaging the electrical components, and also preventing the overflow water from flowing out through the gaps between the components, causing the ice maker to leak.

A water collection box 54 is provided at the middle front of the inner liner 3 and below the overflow pipe 144 of the upper mold fixing piece 14 to collect the overflow water from the overflow pipe 144. The inner cavity of the water collection box 54 is equipped with a sensor to detect whether there is water in the water collection box 54. When water is detected, the sensor sends a signal to the control unit of the ice maker, and the control unit sends an instruction to stop watering the ice making cavity and issues an alarm to prompt the user that there are ice blocks in the ice making cavity. The front bottom of the water collection box 54 is provided with a water collection box drainage hole 55 to drain the overflow water downward and forward into the water storage box 4, thereby avoiding the equipment being soaked by the overflow water.

During operation, the water storage box 4 is filled with water, or the water storage box 4 is connected to an automatic water supply device to keep the water storage box 4 full of water. The water pump 5 starts to work, drawing water from the bottom outlet of the water storage box 4, entering the quantitative water box 7 via the delivery pipe 6. When the water in the quantitative water box 7 exceeds the top surface of the hollow column of the quantitative water box drainage outlet 72, the excess water will be discharged from the quantitative water box drainage outlet 72, and then return to the water storage box 4 through the clean water pipe 50. The water pump 5 is a quantitative water pump, which stops working after supplying a rated amount of water to the quantitative water box 7, or when the quantitative function of the water pump 5 fails, or when the water supply of the water pump 5 is set to be slightly larger than the capacity of the quantitative water box 7, the inductive sensor 51 on the surface of the clean water pipe 50 detects water flow, and the water pump 5 stops working. Afterwards, the solenoid valve 8 is energized to work, and the water flows out from the water outlet 73 of the quantitative water box, then enters the water distribution tank 15 through the water inlet pipe 10, flows into the two water inlet funnels 151 along the two water inlet channels 152 respectively, and then enters the two ice making cavities of the mold through the two water inlet holes 261 on the upper mold 26. The water level balancing channel 262 between adjacent ice making cavities can balance the water level between the cavities. After the water inlet is completed, the compressor 48 starts to work, and the evaporator 33 starts to cool. The evaporator 33 contacts the heat exchange block 12, the heat exchange block 12 contacts the lower mold 13, the lower mold 13 contacts the upper mold 26, and the heat exchange block 12, the lower mold 13, and the upper mold 26 are all made of aluminum. According to the principle of heat conduction, the evaporator 33 quickly transfers the cold to the lower mold 13 and the upper mold 26, and the water in the mold begins to freeze. After the ice making is completed, the ice blocks adhere to the surface of the mold. The compressor 48, the condenser 47, and the evaporator 33 form a refrigeration and heating heat exchange system through pipes and valves. When the evaporator 33 is closed for cooling, the refrigerant flows directly through the capillary channel through which the compressor 48 discharges the high-temperature and high-pressure gas, so that the evaporator 33 is changed from cooling to heating. As the evaporator 33 heats up, the heat is transferred to the lower mold 13 and the upper mold 26 through the heat exchange block 12, and the ice on the surface of the lower mold 13 and the upper mold 26 begins to melt. Since the heat of the upper mold 26 is transferred slowly, and the ice cannot detach from the surface of the upper mold 26, as shown in FIG. 13, the heating wires 58 are attached to the outer surface of the upper mold 26. When the evaporator 33 starts to dissipate heat, the heating wires 58 also work at the same time. When the temperature sensor 74 senses that the temperature of the surface of the upper mold 26 reaches above zero, the heating wires 58 stop working, and at this time, the ice blocks begin to melt slightly and start to demold. The lifting motor 24 starts to work, driving the lifting transmission shaft 22 to rotate, and the worm 21 also starts to rotate, driving the worm wheel 19 to rotate, and the worm wheel 19 drives the screw rod 18 to rotate, thus driving the upper mold fixing piece 14 to move upward, and the upper mold 26 is separated from the lower mold 13. When the top surface of the upper mold fixing piece 14 contacts the limit lever 44 inserted into the side wall of the U-shaped bracket 16, the upward movement stops. The height of the upper mold 26 should be slightly higher than the height required for flipping the lower mold 13. During the upward movement, the ice contacting member 13 extends into the ice making cavity of the upper mold 26. If the ice blocks adhere to the ice making cavity of the upper mold 26 during the upward movement, the ice blocks will contact the ice contacting member 23 during the upward movement of the upper mold 26, and separate from the upper mold 26 and fall into the lower mold 13. After the upward movement of the upper mold 26 stops, the flipping motor 25 starts to work, driving the flipping control piece 30 and the flipping connecting rod 31 to rotate, and then driving the lower mold 13 to rotate toward the door part 2 and the ice receiving basket 59. When the rotating arm 301 on the flipping control piece 30 touches the contact point on the flipping limit sensor 46, the flipping of the lower mold 13 stops, and the ice blocks fall from the lower mold 13 under gravity into the ice receiving basket 59. After the lower mold 13 flips, the condensation water on the heat exchange block 12 can flow into the bottom of the inner liner 3 through the drainage outlet on the top wall of the heat exchange block 12, and during the heating of the evaporator 33 and the heating wires 58, the condensed water on the surface of the lower mold 13 and the upper mold 26 will also drip into the bottom of the inner liner 3 and then be drained into the drainage tank 57 through the drainage pipe 56. After the ice blocks fall, the lower mold 13 reverses and returns to its original position. After returning to its original position, the upper mold fixing piece 14 and the upper mold 26 start to descend, and when the bottom surface of the upper mold fixing piece 14 contacts the limit lever 44 inserted into the side wall of the U-shaped bracket 16, the downward movement stops, and the mold closes again, completing one cycle of operation, including ice making and demolding, and the process can be repeated.

When water is injected into the ice making cavity after the mold is closed, the highest water level in each ice making cavity is lower than the top surface of the ice making cavity. The difference in height between the water surface and the top surface of the ice making cavity can be determined according to the volume of the ice making cavity and the coefficient of expansion of the water when it turns into ice.

To improve the ice making efficiency, as shown in FIG. 7, FIG. 10, and FIG. 11, the top wall of the heat exchange block 12 has a semi-circular concave groove, the shape of which is similar to that of the ice making cavity of the lower mold 13. The ice making cavity of the lower mold 13 is embedded in the concave groove, increasing the contact area between the lower mold 13 and the heat exchange block 12, thereby improving the ice making efficiency.

The ice maker of the present invention has the advantages of simple operation, convenient ice making, quantitative water supply, fast ice making, and the ventilation holes 122 and the lifting device make it easy to flip the lower mold 13, quickly separate the mold from the heat source, and avoid excessive melting of ice blocks during demolding. The ice blocks formed by the upper and lower molds are round in shape, but can also be other arbitrarily demoldable shapes. Additionally, multiple ice block shapes can be set on the same set of molds, and texts, patterns, and other content can be set on the surface of the ice making cavity wall to make the surface of the ice blocks have the company name and logo. Furthermore, it can avoid equipment being soaked by overflow water, thereby improving the reliability and quality of the ice making equipment.

Embodiment 4

The ice maker provided in the present embodiment differs from the ice maker described in the Embodiment 3 in that it uses the ice making module described in the embodiment 2.

Therefore, in the ice maker described in the present embodiment, the quantitative water box 7, the solenoid valve 8, the solenoid valve bracket 9, and the water inlet pipe 10 described in the Embodiment 3 are removed and installed in the inner liner 3, then fixed with screws. Additionally, the clean water pipe 50 and the inductive sensor 51 described in the Embodiment 3 are removed from the ice maker.

The dual-chamber water box 90 described in the Embodiment 2 replaces the water storage box 4 in the Embodiment 3. The interior of the dual-chamber water box 90 is divided into two chambers of different sizes by the partition rib 82. One end of the water outlet connecting pipe 87 is connected to the water outlet 83 of the large chamber of the dual-chamber water box 90, and the other end is connected to the inlet of the water pump 86 in the water storage box. One end of the water inlet connecting pipe 88 is connected to the water inlet 84 of the small chamber of the dual-chamber water box 90, and the other end is connected to the outlet of the water pump 86 in the water storage box. The water outlet 85 of the small chamber is connected to the inlet of the water pump 5, and the outlet of the water pump 5 is connected to the water inlet of the water distribution tank 15 via the delivery pipe 6. As described earlier, when the water pump 86 in the water storage box starts working, water is transported from the large chamber of the dual-chamber water box 90 to the small chamber, and after the small chamber is filled with water, the water pump 86 stops working. Then, the water pump 5 starts working again, and water from the small chamber directly enters the water distribution tank 15 via the delivery pipe 6, and then enters the ice making cavity inside the mold.

Similar to the ice maker described in the Embodiment 3, a water collection box 54 is provided on the front middle part of the inner liner 3 and below the overflow pipe 144 of the upper mold fixing piece 14. It collects overflow water flowing out of the overflow pipe 144, and a water collection box drainage hole 55 is provided at the front bottom of the water collection box 54. However, in the present embodiment, because the dual-chamber water box 90 located below the water collection box 54 has two chambers of different sizes, to ensure that the small chamber 81 functions as a quantitative water box, the water collection box drainage hole 55 directs the overflow water downward and forward into the large chamber 80 of the dual-chamber water box 90, thus avoiding equipment soaking by overflow water.

Embodiment 5

The present embodiment provides a refrigerator with an ice making module, including the ice making module described in the Embodiment 2.

Figure 15:
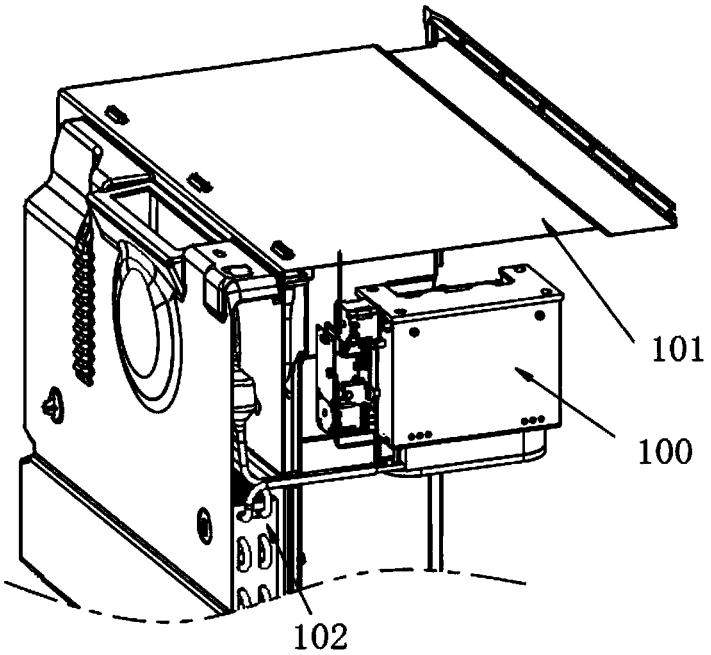
FIG. 15 is a schematic view of the installation of the ice making module in the freezer compartment of the refrigerator in Embodiment 5 of the present invention.
Figure 16:
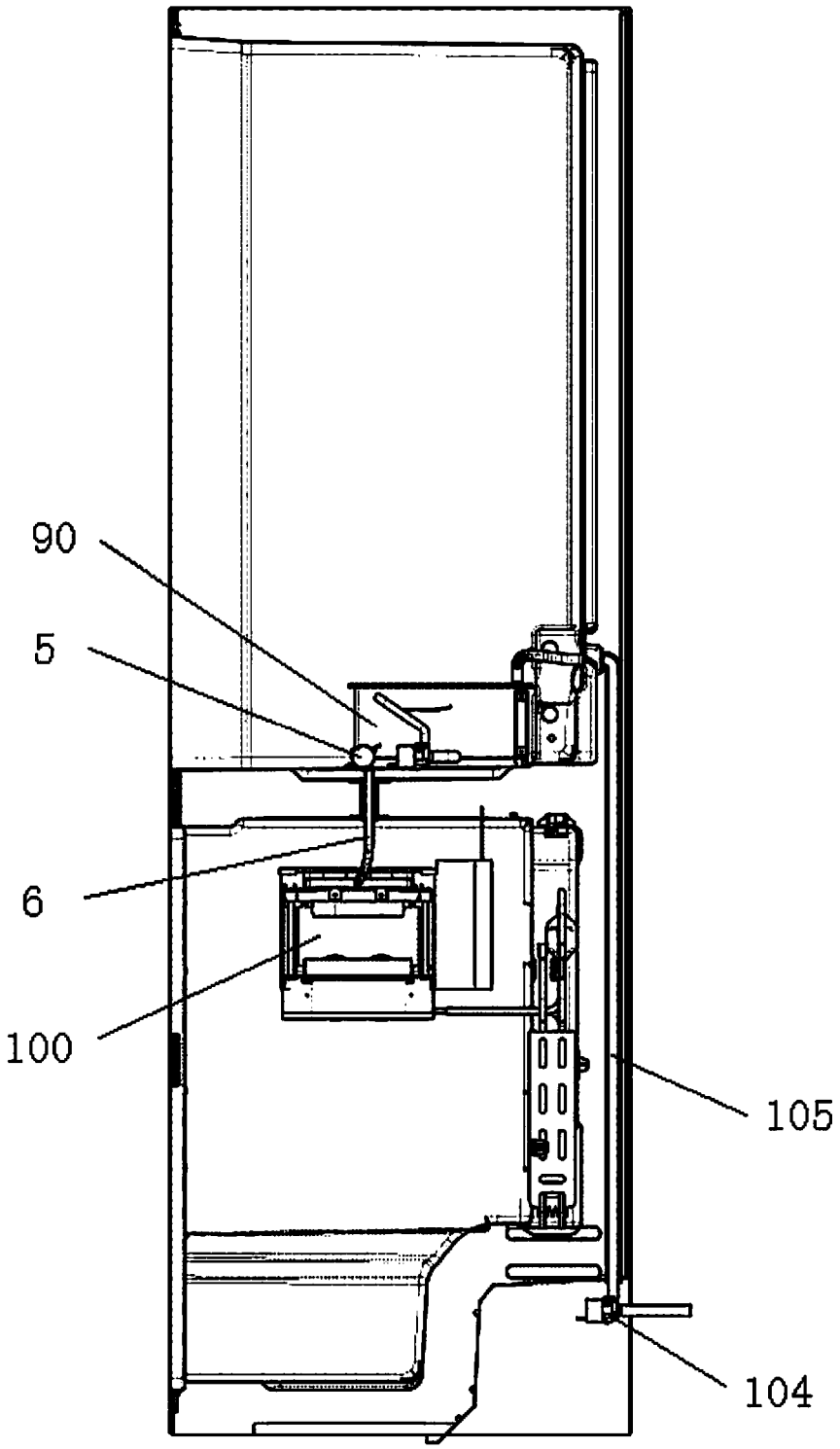
FIG. 16 is a schematic view of the structure of the refrigerator with the ice making module in Embodiment 5 of the present invention.

Referring to FIG. 15 and FIG. 16, the dual-chamber water box 90, the water outlet connecting pipe 87, the water pump 86 in the water storage box, the water inlet connecting pipe 88, and the water pump 5 in the ice making module 100 are all arranged in the refrigeration compartment of the refrigerator. Other parts of the ice making module 100 are set in the freezer compartment of the refrigerator. One end of a water supply pipe 6 is connected to the outlet of the water pump 5, and the other end extends into the freezer compartment of the refrigerator and connects to the water inlet of the water distribution tank 15.

The refrigerator with the ice making module further includes a water supply pipeline 105 and a water supply pump 104. One end of the water supply pipeline 105 is connected to the water source, and the other end passes through the foaming layer into the refrigeration compartment and connects to the large chamber 80 of the dual-chamber water box 90, where water is injected and stored. The water supply pump 104 is installed on the water supply pipeline 105 to provide water quantitatively to the large chamber 80.

Since the dual-chamber water box 90 is located in the refrigeration compartment, the water inside it cools down in the refrigeration compartment, which facilitates ice making and reduces the time required for ice making and the consumption of cooling energy during ice making. The water in the small chamber 81 of the dual-chamber water box 90 passes through the delivery pipe 6, penetrates the foaming layer, enters the ice making module 100 in the freezer compartment of the refrigerator, and then enters the ice making cavity formed by the upper and lower molds through the water distribution tank 15.

The refrigerator also includes an ice receiving basket for collecting ice when the lower mold is flipped for demolding.

The parts of the ice making module 100 and the ice receiving basket located in the freezer compartment of the refrigerator can be set on the inner wall of the freezer compartment 101 according to spatial design needs, or suspended in the freezer compartment, or set on the door body of the freezer compartment, as long as they are located in the freezer compartment of the refrigerator, they fall within the scope of the technical solution to be protected in this application.

The evaporator 33 of the ice making module 100 is connected in series with the refrigerator's evaporator via pipes. The compressor of the refrigerator drives the evaporator 33 of the ice making module 100 to achieve ice making. The heat exchange block 12 of the ice making module 100 is equipped with heating wires inside, which work after ice making is completed. The heat is transferred to the lower mold 13 and the upper mold 26 through the heat exchange block 12, causing slight melting of the ice block surface, then demolding and ice collection, realizing direct cooling ice making.

Embodiment 6

Figure 17:
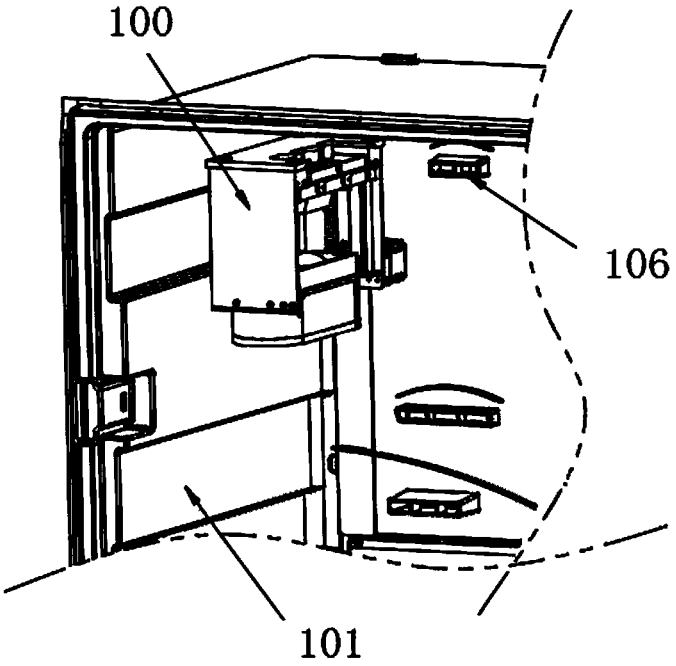
FIG. 17 is a schematic view of the installation of the ice making module in the freezer compartment of the refrigerator in Embodiment 6 of the present invention.

The present embodiment provides a refrigerator with an ice making module, which differs from the refrigerator with an ice making module described in the Embodiment 5 in that:

The refrigerator is an air-cooled refrigerator. As shown in FIG. 17, the ice making module 100 does not have an evaporator, a compressor, or a condenser inside. The upper mold 26 and the lower mold 13 of the ice making module 100 and the ice making cavity formed by the upper and lower molds are located in front of an air outlet 106 of the freezer compartment of the refrigerator. The refrigeration module in the ice making module utilizes the refrigeration system of the air-cooled refrigerator. Air blown from the air outlet 106 of the freezer compartment directly contacts the surface of the mold and the heat exchange block 12, transfers to the inside of the mold, and freezes the water. Additionally, heating wires are attached to the outer wall of the ice making cavity. After ice making is completed, the heating wires work, transferring heat to the upper mold 26 and the lower mold 13, causing slight melting of the ice block surface, then demolding and ice collection, realizing air-cooled ice making.

Embodiment 7

The present embodiment provides a refrigerator with an ice making module, including the ice making module described in the Embodiment 1.

The quantitative water box 7 in the ice making module is located in the refrigeration compartment of the refrigerator, while the other parts of the ice making module are set in the freezer compartment of the refrigerator.

The refrigerator also includes a water supply pipeline and a water supply pump. One end of the water supply pipeline is connected to the water source, and the other end passes through the foaming layer into the refrigeration compartment, connecting to the water inlet 71 of the quantitative water box. The water supply pump is installed on the water supply pipeline to quantitatively supply water to the quantitative water box 7.

The outlet 73 of the quantitative water box 7 is connected to the inlet of the solenoid valve 8 via a pipe. The outlet of the solenoid valve 8 is connected to the water inlet pipe 10. The water inlet pipe 10 passes through the foaming layer into the freezer compartment, connecting to the water inlet of the water distribution tank 15, which leads to the ice making cavity formed by the upper and lower molds.

The refrigerator also includes an ice receiving basket for collecting ice when the lower mold is flipped for demolding. The ice receiving basket is located in the freezer compartment of the refrigerator.

The evaporator 33 of the ice making module is connected in series with the refrigerator's evaporator via pipes. The compressor of the refrigerator drives the evaporator 33 of the ice making module to achieve ice making. The heat exchange block 12 of the ice making module is equipped with heating wires inside, which work after ice making is completed. The heat is transferred to the lower mold 13 and the upper mold 26 through the heat exchange block 12, causing slight melting of the ice block surface, then demolding and ice collection, realizing direct cooling ice making.

Embodiment 8

The present embodiment provides a refrigerator with an ice making module, differing from the embodiment 7 in that:

The refrigerator is an air-cooled refrigerator. The inside of the ice making module does not contain an evaporator, a compressor, or a condenser. The upper mold 26 and the lower mold 13 of the ice making module, as well as the ice making cavity formed by the upper and lower molds, are located in front of the air outlet of the freezer compartment of the refrigerator. The refrigeration module in the ice making module utilizes the refrigeration system of the air-cooled refrigerator. Air blown from the air outlet of the freezer compartment directly contacts the surface of the mold and the heat exchange block 12, transfers to the inside of the mold, and freezes the water. Additionally, heating wires are attached to the outer wall of the ice making cavity. After ice making is completed, the heating wires work, transferring heat to the upper mold 26 and the lower mold 13, causing slight melting of the ice block surface, then demolding and ice collection, realizing air-cooled ice making.

The refrigerator provided by the present invention has an ice making module, which not only has all the beneficial effects of the ice making module but also can save energy by connecting the evaporator of the refrigerator itself with the evaporator of the ice making module in series, or directly utilize the air blown from the air outlet of the freezer compartment of the refrigerator to cool the mold for ice making, thereby saving energy.

Embodiment 9

Figure 21:
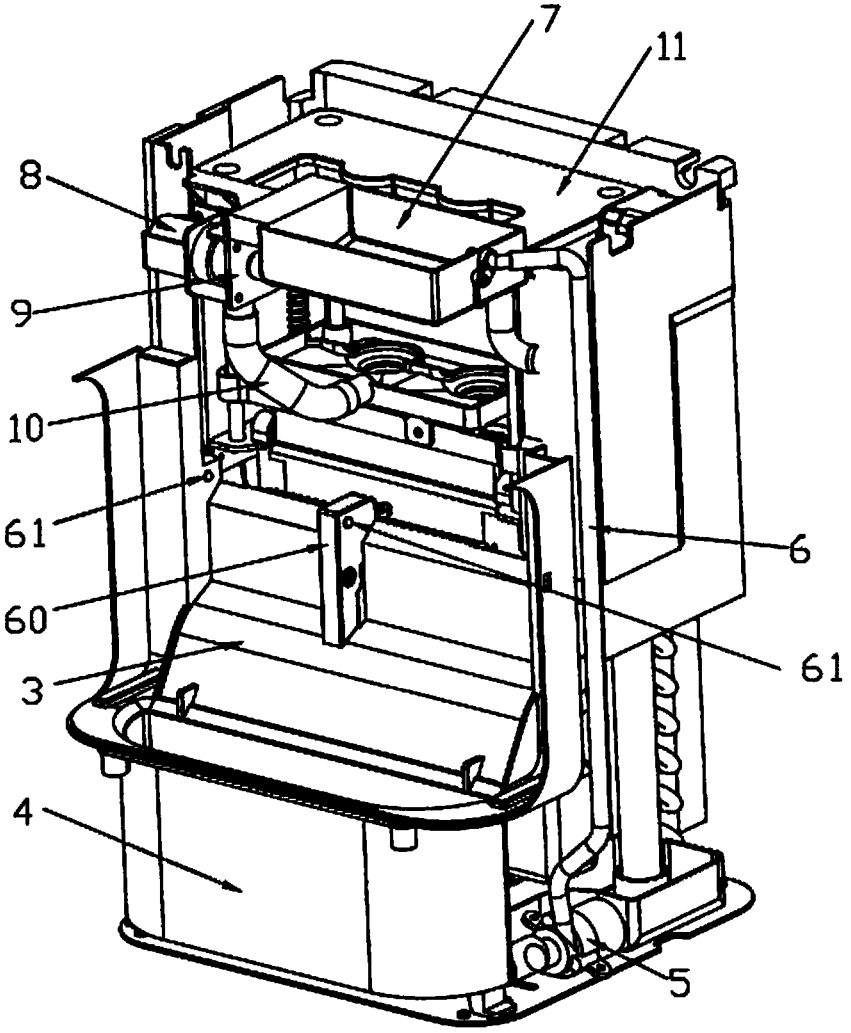
FIG. 21 is a schematic view of the installation of the ice release detection device in the ice maker in Embodiment 9 of the present invention.

The present embodiment provides an ice maker, differing from the Embodiment 3 in that: the water collection box 54, the overflow channel 143, and the overflow pipe 144 of the ice maker in the Embodiment 3 are removed. The first annular wall top of the avoidance hole 142 formed on the upper mold fixing member 14 no longer has the first gap 145, and the second annular wall of the water inlet hole 261 formed on the top of the upper mold 26 no longer has the second gap 263. Additionally, the ice sensor 53 for detecting whether the ice receiving basket is full of ice is removed; instead, as shown in FIG. 21, an ice release detection device for detecting whether the ice blocks have fallen out is added.

The ice release detection device includes the ice release detection sensors 61 arranged in pairs. The ice release detection sensors 61 are provided below the lower mold 13 and above the inner liner 3, corresponding to the position of each ice making cavity. When the lower mold 13 flips, the ice release detection sensors 61 detect whether ice blocks have passed through and send the detection results to the control unit. If the lower mold 13 flips but the control unit does not receive the signal from the ice release detection sensors 61, the control unit stops the reverse reset of the lower mold 13 or, after the upper and lower molds are closed, the control unit stops pumping water for ice making again; and an alarm is triggered.

When there are multiple ice making cavities, taking two ice making cavities as an example, for the convenience of installing the ice release detection sensors 61, the ice release detection device also includes a sensor fixing box 60.

The sensor fixing box 60 is set on the front part of the inner liner, between two adjacent ice making cavity chambers, without affecting the flipping of the lower mold and the escape of ice blocks from the ice making cavity. Ice release detection sensors 61 are further installed on each side of the sensor fixing box 60, forming two pairs with the ice release detection sensors 61 installed on the left and right sides of the inner liner 3. According to these arrangements, four ice release detection sensors 61 form two pairs, and when ice blocks fall, the ice release detection sensors 61 can sense them.

Embodiment 10

The present embodiment provides an ice maker, differing from the Embodiment 4 in that: the water collection box 54, the overflow channel 143, and the overflow pipe 144 of the ice maker in the Embodiment 4 are removed. The first annular wall top of the avoidance hole 142 formed on the upper mold fixing member 14 no longer has the first gap 145, and the second annular wall of the water inlet hole 261 formed on the top of the upper mold 26 no longer has the second gap 263. Additionally, the ice sensor 53 for detecting whether the ice receiving basket is full of ice is removed; instead, as shown in FIG. 21, an ice release detection device for detecting whether the ice blocks have fallen out is added.

The ice release detection device in the present embodiment is the same as that in the Embodiment 9.

The above-described embodiments are merely preferred embodiments of the present invention and are not intended to limit the present invention in any form. Although the present invention has been disclosed with preferred embodiments, it is not intended to limit the present invention. Any person skilled in the art can make slight modifications, equivalent changes, or modifications to the above embodiments without departing from the technical scope of the present invention. Any simple modification, equivalent change, or modification made to the above embodiments based on the technical essence of the present invention still falls within the scope of the present invention.

What is claimed is:

1. An ice making module, characterized by comprising: an upper mold, a lower mold, a refrigeration module, a quantitative water supply system, a separation mechanism and an ice release mechanism;

wherein:

the upper mold and the lower mold cooperate to form multiple ice making cavities, and the quantitative water supply system supplies water quantitatively to the ice making cavities;

the ice making cavities are connected to the refrigeration module, the separation mechanism drives the upper mold and the lower mold to separate, and the ice release mechanism drives the formed ice blocks out of the ice making cavities after the upper mold and the lower mold are separated;

wherein the ice making module further comprises: a heat transfer block that is attached to the bottom of the lower mold and connected to an evaporator of the refrigeration module to transfer cold to the lower mold; and at least one of a separation device or ventilation holes, the separation device is used to separate the heat transfer block and the lower mold, and the ventilation holes connect a gap between the heat transfer block and the lower mold;

wherein the ice making module further comprises: a bracket;

the separation mechanism comprises a lift motor and a lift transmission device;

the lift motor is fixed on the bracket and connected to the lift transmission device, and the lift transmission device drives the upper mold to move up and down;

wherein the ice making module further comprises an upper mold cover fixed to the top of the upper mold; the upper mold cover is connected to the lift transmission device and the lift transmission device drives the upper mold to move up and down.

2. The ice making module according to claim 1, wherein the ice making module further comprises ice breaking components fixed to the bracket and located directly above water inlet holes at the top of the upper mold; when the upper mold moves up, the ice breaking components insert into the water inlet holes to exert force on the ice blocks remaining in the upper mold to cause them to be released.

3. The ice making module according to claim 1, wherein the ice releasing mechanism comprises a flipping motor, a flipping transmission device and a flipping limit device;

the flipping transmission device is connected to an output shaft of the flipping motor and the lower mold, respectively; the flipping limit device controls the flipping angle and direction of the flipping motor.

4. The ice making module according to claim 1, wherein the quantitative water supply system comprises a dual-chamber water box, a water pump and water pipes; the dual-chamber water box is divided into a large chamber and a small chamber by a partition rib with a partition gap provided at the top; the side wall of the small chamber has a water inlet, which is higher than the partition gap and/or the partition; the bottom of the small chamber has a water outlet connected to the water pump and the water inlet hole of the upper mold through the water pipe.

5. The ice making module according to claim 4, wherein the water inlet of the small chamber is connected to a water source through a water pipe and a water pump that controls the quantitative water intake.

6. The ice making module according to claim 1, wherein the quantitative water supply system comprises a quantitative water box, a solenoid valve and water pipes; a water source is connected to the water inlet of the quantitative water box through a water pump and water inlet pipes, providing quantitative water; the water outlet of the quantitative water box is connected to the water inlet holes of the upper mold through a solenoid valve and water pipes; the quantitative water box is equipped with an overflow outlet to ensure a constant water level inside the quantitative water box.

7. An ice maker, characterized by comprising an ice making module according to claim 1, the top of a first annular wall of the upper mold cover, which comprises an avoiding hole, is provided with a first gap; the water inlet hole of the upper mold is located in the avoiding hole, and the first gap is connected to an overflow pipe through an overflow channel; the overflow pipe drains to a water storage box or the large chamber of the dual-chamber water box.

8. The ice maker according to claim 7, further comprising an outer shell part, a door part, an ice receiving basket and a water collection box; the ice making module is located in the inner cavity formed by the outer shell part; the front side of the outer shell part is provided with an opening corresponding to the position of the lower mold; the door part is located at the opening, and the ice receiving basket is located inside the door and below the lower mold; the water collection box is provided below the overflow pipe, and a sensor is installed at the bottom of the inner cavity of the water collection box; the water collection box receives the overflow water and drains it to the water storage box or the large chamber of the dual-chamber water box.

9. The ice maker according to claim 8, further comprising an ice sensor to detect whether the ice receiving basket is full.

10. The ice maker according to claim 7, further comprising an ice release detection device to detect whether the ice blocks have been released.

11. A refrigerator, characterized by comprising: the ice making module according to claim 4, the dual-chamber water box or a quantitative water box is located in a refrigeration compartment, an evaporator of the refrigeration module is connected to an evaporator of the refrigerator; and the ice making module and the ice receiving basket are located in a freezer compartment of the refrigerator;

or, characterized by comprising: the ice making module according to claim 4, the dual-chamber water box is located in the refrigeration compartment of a frost-free refrigerator; the refrigeration module uses the refrigeration system of the frost-free refrigerator, and cold air is directly blown onto surface of molds from an air vent of a freezer compartment for ice making.

12. A refrigerator, characterized by comprising: the ice making module according to claim 6, a dual-chamber water box or the quantitative water box is located in a refrigeration compartment, an evaporator of the refrigeration module is connected to an evaporator of the refrigerator; and the ice making module and the ice receiving basket are located in a freezer compartment of the refrigerator;

or, characterized by comprising: the ice making module according to claim 6, the quantitative water box is located in the refrigeration compartment of a frost-free refrigerator; the refrigeration module uses the refrigeration system of the frost-free refrigerator, and cold air is directly blown onto surface of molds from an air vent of a freezer compartment for ice making.

13. An ice maker comprising:

an ice making module according to claim 6;

a water storage box, wherein the top of a first annular wall of the upper mold cover, which comprises an avoiding hole, is provided with a first gap; the water inlet hole of the upper mold is located in the avoiding hole, and the first gap is connected to an overflow pipe through an overflow channel; the overflow pipe drains to a water storage box or a large chamber of a dual-chamber water box.

14. The ice maker according to claim 13, wherein the ice maker includes an out shell part, a door part, an ice receiving basket and a water collection box; the ice making module is located in the inner cavity formed by the out shell part; the front side of the out shell is provided with an opening corresponding to the position of the lower mold; the door part is located at the opening, and the ice receiving basket is located inside the door and below the lower mold; the water collection box is provided below the overflow pipe, and a sensor is installed at the bottom of the inner cavity of the water collection box; the water collection box receives the overflow water and drains it to the water storage box or the large chamber of the dual-chamber water box.

* * * * *